US007403727B2

(12) United States Patent
Fujimori et al.

(10) Patent No.: US 7,403,727 B2
(45) Date of Patent: Jul. 22, 2008

(54) IMAGE FORMING APPARATUS AND DENSITY ADJUSTING METHOD THEREOF

(75) Inventors: Takashi Fujimori, Moriya (JP); Yoritsugu Maeda, Toride (JP); Satoru Kanno, Kashiwa (JP)

(73) Assignee: Canon Kabushiki Kaisha (JP)

( * ) Notice: Subject to any disclaimer, the term of this patent is extended or adjusted under 35 U.S.C. 154(b) by 88 days.

(21) Appl. No.: 11/465,971

(22) Filed: Aug. 21, 2006

(65) Prior Publication Data

US 2007/0047986 A1 Mar. 1, 2007

(30) Foreign Application Priority Data

Aug. 31, 2005 (JP) ..... 2005-252468

(51) Int. Cl.
*G03G 15/00* (2006.01)
*G03G 15/16* (2006.01)

(52) U.S. Cl. ..... 399/49; 399/26; 399/44; 399/66; 399/302

(58) Field of Classification Search ..... 399/49, 399/66, 72, 302, 26, 44, 308
See application file for complete search history.

(56) References Cited

U.S. PATENT DOCUMENTS 6,181,892 B1 * 1/2001 Fujimori ..... 399/72
6,434,348 B1 * 8/2002 Tomizawa ..... 399/66
6,564,021 B1 * 5/2003 Nakai et al. ..... 399/49
7,072,598 B2 7/2006 Takayanagi

FOREIGN PATENT DOCUMENTS

| | | | |
|---|---|---|---|
| JP | 2000-221738 A | | 8/2000 |
| JP | 2001-166553 A | | 6/2001 |
| JP | 2002-14505 A | | 1/2002 |
| JP | 2002-186848 A | * | 5/2002 |
| JP | 2004-69919 A | | 3/2004 |
| JP | 2004-325793 A | | 11/2004 |
| JP | 2004-333707 A | | 11/2004 |

* cited by examiner

*Primary Examiner*—Sophia S Chen
(74) *Attorney, Agent, or Firm*—Rossi, Kimms & McDowell LLP

(57) ABSTRACT

The present invention performs density adjustment (ATR process) and transfer voltage control (ATVC) in parallel; the ATR process transfers and forms a patch image on an intermediate transfer member and detects and adjusts the density of the patch image, and the ATVC gradually raises a transfer voltage to measure a transfer current and generates a transfer voltage corresponding to a target transfer current to control a transfer of an image from an image carrier to the intermediate transfer member. The present invention determines the timing at which the patch image is formed in the density adjustment, in association with the transfer voltage in the transfer voltage control step, to allow a density adjustment process based on density adjustment and transfer voltage control to be executed in parallel.

12 Claims, 16 Drawing Sheets

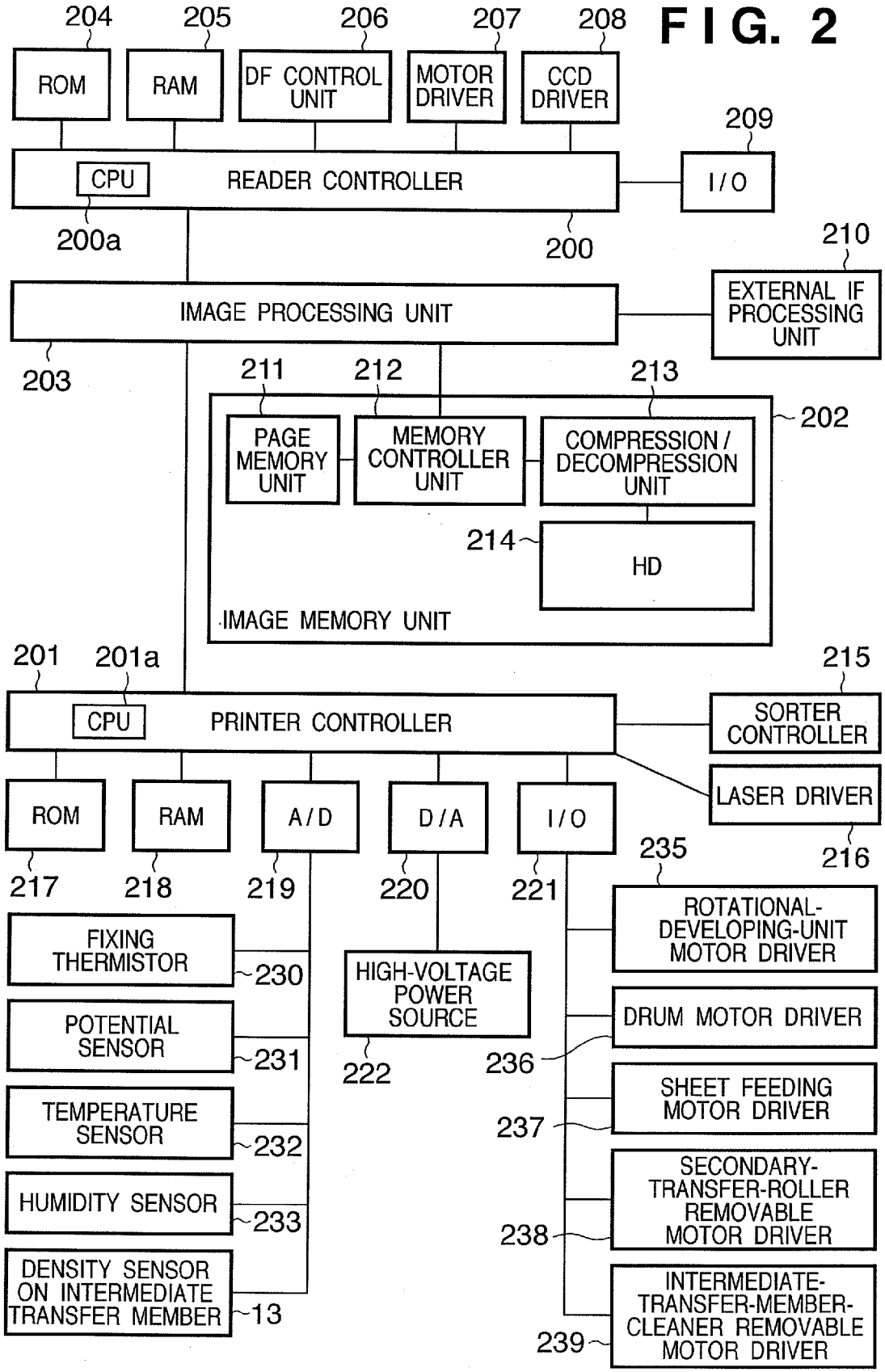
FIG. 2
204
205
206
207
208
ROM
RAM
DF CONTROL UNIT
MOTOR DRIVER
CCD DRIVER
209
CPU
READER CONTROLLER
I/O
200a
200
210
IMAGE PROCESSING UNIT
EXTERNAL IF PROCESSING UNIT
203
211
212
213
202
PAGE MEMORY UNIT
MEMORY CONTROLLER UNIT
COMPRESSION / DECOMPRESSION UNIT
214
HD
IMAGE MEMORY UNIT
201
201a
215
CPU
PRINTER CONTROLLER
SORTER CONTROLLER
LASER DRIVER
ROM
RAM
A/D
D/A
I/O
216
217
218
219
220
221
235
FIXING THERMISTOR
230
HIGH-VOLTAGE POWER SOURCE
ROTATIONAL-DEVELOPING-UNIT MOTOR DRIVER
POTENTIAL SENSOR
231
222
236
DRUM MOTOR DRIVER
TEMPERATURE SENSOR
232
237
SHEET FEEDING MOTOR DRIVER
HUMIDITY SENSOR
233
238
SECONDARY-TRANSFER-ROLLER REMOVABLE MOTOR DRIVER
DENSITY SENSOR ON INTERMEDIATE TRANSFER MEMBER
13
239
INTERMEDIATE-TRANSFER-MEMBER-CLEANER REMOVABLE MOTOR DRIVER

FIG. 10

| | V [v] | I [μA] |
|---|---|---|
| 1 | 1000 | 8 |
| 2 | 2000 | 22 |
| 3 | 3000 | 35 |

IMAGE FORMING APPARATUS AND DENSITY ADJUSTING METHOD THEREOF

BACKGROUND OF THE INVENTION

1. Field of the Invention

The present invention relates to an image forming apparatus based on, for example, an electrophotographic scheme, and a density adjusting method for the apparatus.

2. Description of the Related Art

For color image forming apparatuses that print color images on the basis of an electrophotographic scheme, a process of adjusting the image forming apparatus (this process is hereinafter referred to as an image adjusting process) needs to be executed in a sequence different from an image forming process of actually forming images, in order to stabilize the quality of formed (printed) images. Control for the image adjusting process includes an ATR (Automatic Toner Refresh) patch detection process of making the color perception of formed images constant and ATVC (Automatic Transfer Voltage Control) that allows a toner image formed on a photosensitive member to be appropriately transferred to a paper or a transfer member.

The ATR patch detection process is control which makes the color perception of formed images constant and which maintains the fixed concentration ratio of toner to a carrier (developing material) in a developer. This control periodically supplies a developer with toner the amount of which is equal to that of toner consumed for image formation. Toner supply is controlled by forming a patch image on a photosensitive member or a transfer member so that a photo sensor placed opposite the patch image formed detects reflected light from the patch image to determine the concentration ratio of the developing material to the toner.

Image forming apparatuses such as printers and copiers transfer a toner image formed on a photosensitive drum that is a photosensitive member or on an image carrier to a print sheet (transferred member) such as a sheet of paper or an intermediate transfer member. On this occasion, a transfer member such as a transfer roller is abutted against the photosensitive drum to form a transfer nip (transfer site). A transfer bias is then applied to the transfer member with the print sheet passed through the transfer nip. This allows the toner image on the photosensitive drum to be transferred to the print sheet. The transfer roller, serving as the transfer member, normally has its resistance value appropriately adjusted by dispersing conductive particles in an elastic member such as rubber or sponge. However, the resistance value of such a transfer roller varies significantly as a result of a manufacturing variation, an environmental variation, or the lifetime. This makes it difficult to offer high transferability through stable application of the transfer bias.

Ideally, the amount of electric charge applied to the back surface of the print sheet is appropriately controlled in order to offer constant high transferability. To achieve this, for example, the transfer roller may be controllably subjected to a fixed current. However, the passage width (the width of print sheets perpendicular to a conveying direction) of print sheets for the image forming apparatus is not fixed. The width of a part of the transfer roller which directly contacts the surface of the image carrier thus varies depending on the width of print sheets used. This causes the load impedance of the transfer roller with respect to the surface of the image carrier to vary between a part of the transfer roller which contacts the print sheet and a part which does not contact the print sheet. Particularly in an area in which no print sheet is present (the drum or the intermediate transfer member directly contacts the transfer roller), the load impedance is so small as to allow a large current to flow in a concentrated manner. This may result in low transferability in an area in which the print sheet is present.

To eliminate such a disadvantage of the simple constant current control, an ATVC scheme has been proposed. This scheme passes a given current through the transfer roller with no print sheet at the transfer nip and records a generated voltage required for the transfer; the given current is determined by assuming a current passed through the transfer roller during a transfer operation. During actual transfer, a corrected voltage is applied which is equal to the generated voltage, the generated voltage multiplied by a coefficient, or the generated voltage to which a constant is added. However, the ATVC scheme requires a constant current circuit, which increases costs. Moreover, the ATVC scheme employs a hardware configuration with a capacitor as means for storing an output voltage during a constant current operation. Thus, the output voltage during transfer may be affected by a variation in capacitor voltage caused by leakage, the tolerance of gain resistance, or a variation in temperature characteristics. Further, the ATVC scheme is implemented using hardware. As a result, constants, for example, a constant current value and coefficients required to correct the generated voltage to the appropriate transfer voltage are determined in a stage of a circuit design of the image forming apparatus. Thus, the ATVC scheme is disadvantageously limited to the simple bias control.

To eliminate this disadvantage, a software-based ATVC scheme has been proposed which uses means for digitally increasing or reducing the voltage applied to the transfer roller, means for detecting a current flowing from the transfer roller into the image carrier, and means for determining whether or not the current flowing from the transfer roller into the image carrier has reached a desired value (target current). This scheme enables the current flowing from the transfer roller into the image carrier to converge to a given value to achieve control equivalent to that of the constant current circuit in the hardware-based ATVC scheme. The software-based ATVC scheme applies a transfer bias step by step and detects a current flowing from the transfer roller into the image carrier. When the current flowing from the transfer roller into the image carrier reaches the target current value, this control is ended. The transfer bias is then stored in a RAM or the like so as to be applied during the following transfer. However, this ATVC scheme requires the output voltage to be repeatedly varied step by step until the current flowing from the transfer roller into the image carrier reaches the given value. This disadvantageously increases control time. If the circumferential resistance of the transfer roller varies markedly as a result of a manufacturing error, the current at each output voltage is desirably determined by averaging the current values obtained during at least one rotation of the transfer roller. If the current detecting circuit operates under a state of heavy noise, the current at each output voltage is desirably more frequently sampled for averaging. However, such an averaging process further increases the control time.

The above ATR patch detection process and ATVC process are adjustive control required to allow the apparatus to output stable images. However, during the execution of the ATVC, the current flowing from the transfer roller into the image carrier needs to be monitored with the transfer voltage varied until the current converges to the given target value. Thus, an attempt to control ATR patch detection during the ATVC may cause a patch image for the ATR patch detection control to be affected by a variation in transfer voltage based on the ATVC.

This may lead to incorrect density corrections. Thus, these control operations needs to be sequentially executed.

In short, the conventional system must sequentially execute the ATR patch detection process and ATVC process at different timings; both the ATR patch detection process and ATVC process are adjustive control required to stabilize images. Thus, the duration of the adjustments equals the simple sum of the control times of the ATR patch detection and the ATVC process. This may disadvantageously degrade productivity for users.

Japanese Patent Laid-Open Nos. 2001-166553 and 2002-014505 disclose the simultaneous execution of image density correction and auto registration correction. However, these documents do not teach the image density correction executed in parallel with the ATVC.

SUMMARY OF THE INVENTION

The present invention eliminates the disadvantages of the prior art.

The feature of the present invention is to provide an image forming apparatus that reduces the time required to adjust density as well as a density adjustment method for the image forming apparatus.

According to the present invention, there is provided with an image forming apparatus for forming an image by transferring an image formed on an image carrier and developed with a developing material, to an intermediate transfer member and then transferring the image to a transfer member, the apparatus comprising:

a density adjustment unit configured to detect and adjust the density of a patch image transferred to the intermediate transfer member;

a transfer voltage determining unit configured to gradually vary a transfer voltage to determine a transfer voltage for a transfer of the image from the image carrier to the intermediate transfer member;

a determination unit configured to determine how the image carrier is degraded; and a control unit configured to, in accordance with the determination by the determination unit, control a transfer timing for a transfer of the patch image to the intermediate transfer member, in parallel with the determination by the transfer voltage determining unit.

Further, according to the present invention, there is provided with an image forming apparatus for forming an image by transferring an image formed on an image carrier and developed with a developing material, to an intermediate transfer member and then transferring the image to a transfer member, the apparatus comprising:

a density adjustment unit configured to detect and adjust the density of a patch image transferred to the intermediate transfer member;

a transfer voltage determining unit configured to gradually vary a transfer voltage to determine a transfer voltage for a transfer of the image from the image carrier to the intermediate transfer member;

a determination unit configured to determine how the image carrier is degraded; and a control unit configured to, in accordance with the determination by the determination unit, control a transfer timing for a transfer of the patch image to the intermediate transfer member, with respect to the transfer voltage gradually varied by the transfer voltage determining unit.

Further, according to the present invention, there is provided with an image forming apparatus for forming an image by transferring an image formed on an image carrier and developed with a developing material, to an intermediate transfer member and then transferring the image to a transfer member, the apparatus comprising:

a density adjustment unit configured to transfer and form a patch image on the intermediate transfer member and to detect and adjust the density of the patch image;

a transfer control unit configured to gradually raise a transfer voltage to measure a transfer current and to generate a transfer voltage corresponding to a target transfer current to control a transfer of the image from the image carrier to the intermediate transfer member; and a control unit configured to perform control such that a timing at which the density adjustment unit forms the patch image is determined in association with the transfer voltage generated by the transfer voltage control unit to allow a density adjustment process using the density adjustment unit and the transfer voltage control unit to be executed in parallel.

According to the present invention, there is provided with a density adjustment method for an image forming apparatus for forming an image by transferring an image formed on an image carrier and developed with a developing material, to an intermediate transfer member and then transferring the image to a transfer member, the method comprising:

a density adjustment step of transferring and forming a patch image on the intermediate transfer member and detecting and adjusting the density of the patch image;

a transfer voltage control step of gradually raising a transfer voltage to measure a transfer current and generating a transfer voltage corresponding to a target transfer current to control a transfer of the image from the image carrier to the intermediate transfer member; and a control step of controlling such that a timing at which the patch image is formed in the density adjustment step is determined in association with the transfer voltage generated in the transfer voltage control step, and executing a density adjustment process using the density adjustment step and the transfer voltage control step in parallel.

Further features of the present invention will become apparent from the following description of exemplary embodiments (with reference to the attached drawings).

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 2 is a block diagram showing the configuration of the color image forming apparatus according to the present embodiment;

FIG. 10 is a diagram showing an example of a V-I characteristic table stored in a RAM according to the present embodiment;

DESCRIPTION OF THE EMBODIMENTS

A preferred embodiment of the present invention will be described below in detail with reference to the attached drawings. The present invention according to the claims is not limited to the embodiment described below. Not all the combinations of characteristics described in the present embodiment are essential to the solution of the present invention.

Figure 1:
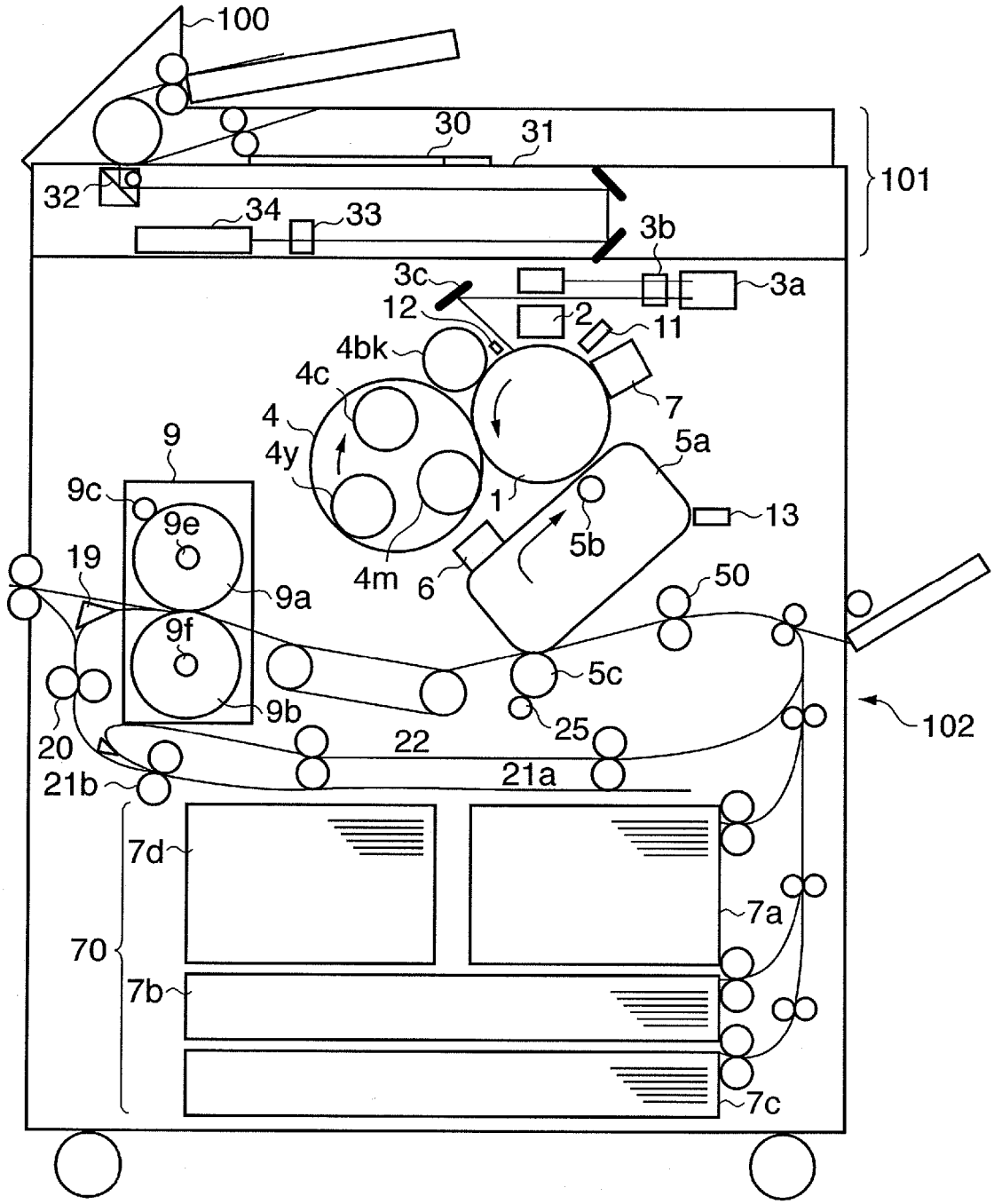
FIG. 1 depicts a schematic sectional view illustrating the configuration of a color image forming apparatus (copier) according to an embodiment of the present invention.

FIG. 1 depicts a schematic sectional view illustrating the configuration of a color image forming apparatus (copier) according to the embodiment of the present invention.

The color image forming apparatus has a digital color image reader 101 (hereinafter referred to as a reader unit 101) provided in the upper part, a digital color printer 102 (hereinafter referred to as a printer unit 102) provided in the lower part, and an image processing unit 203 (FIG. 2) to which image data from the reader unit 101 is input and which executes image processing on the image data and outputs the processed data to the printer unit 102.

The reader unit 101 exposes and scans an original 30 placed on a platen glass 31, via an exposure lamp 32. The reader unit 101 further condenses a reflected light image from the original 30 on a full color sensor 34 integrated with an RGB three-color separation filter, via a lens 33. A color separated analog image signal thus output by the full color sensor 34 is converted into a digital signal by an amplifying circuit (not shown). The digital signal is then input to the image processing unit 203 (FIG. 2), which then processes the digital signal to create image data to be transmitted to the printer unit 102. Reference numeral 100 denotes an auto document feeder (ADF).

Now, the configuration of the printer unit 102 will be described. A photosensitive drum 1 serving as an image carrier is carried so as to be rotatable in the direction of the arrow in the figure. The following are arranged around the photosensitive drum 1: a pre-exposure lamp 11, a corona charger 2, laser exposure optical systems (3*a*, 3*b*, and 3*c*), a potential sensor 12, a rotational developing unit 4 (developers 4*y* (yellow), 4*c* (cyan), 4*m* (magenta), and 4*bk* (black)), an intermediate transfer member 5*a*, a light amount detection sensor 13 that detects the density of a toner image on the intermediate transfer member 5*a*, and a cleaning unit 6.

The configuration of the laser exposure optical system will be described. An image signal from the image processing unit 203 is converted into an optical signal (laser light) by a laser output unit (not shown). The resulting laser light is reflected by a polygon mirror 3*a* and projected on the surface of the photosensitive drum 1 via a lens 3*b* and a mirror 3*c*. During image formation, the photosensitive drum 1 is rotated in the direction of the arrow in the figure. The photosensitive drum 1 from which static electricity has been removed by the pre-exposure lamp 11 is uniformly charged by the charger 2. The photosensitive drum 1 is irradiated with laser light for each color to form on the surface of the drum an electrostatic latent image corresponding to an image signal for that color. A corresponding developer in the rotational developing unit 4 is then operated to develop the electrostatic latent image on the photosensitive drum 1 with a developing material of the corresponding color. A toner image of the color is formed on the photosensitive drum 1. The rotational developing unit 4 is then rotated by a developing rotary motor to selectively cause one of the developers 4*y*, 4*c*, and 4*m* for the colors to approach to the photosensitive drum 1. Development is thus carried out which corresponds to each color. A black image is developed using toner from the developer 4*bk*.

The toner image developed on the photosensitive drum 1 is transferred to the intermediate transfer belt 5*a* by a high voltage applied by a primary transfer charger. In the present embodiment, for a print sheet (250 mm) having a length equal to or smaller than the half of the entire circumference of the intermediate transfer belt 5*a*, images corresponding to two print sheets can be simultaneously formed on the intermediate transfer member 5*a*. Thus, the following is called 2-sheets forming control: the case in which images corresponding to two print sheets are simultaneously formed on the intermediate transfer member 5*a*. The following is called 1-sheet forming control: the case in which an image corresponding to one print sheet is formed on the intermediate transfer member 5*a*.

Figure 3A:
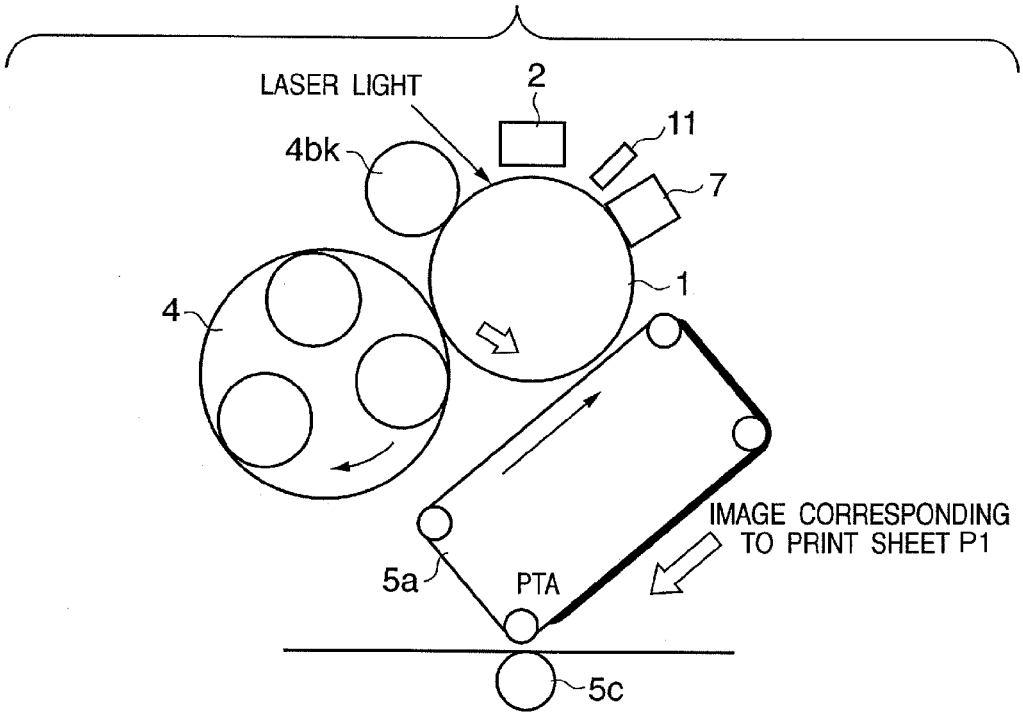
FIGS. 3A and 3B depicts a views(FIG. 3A) illustrating that an image is formed on an intermediate transfer belt according to the present embodiment under 1-sheet forming control and a view (FIG. 3B) illustrating that an image is formed on an intermediate transfer belt according to the present embodiment under 2-sheets forming control.
Figure 3B:
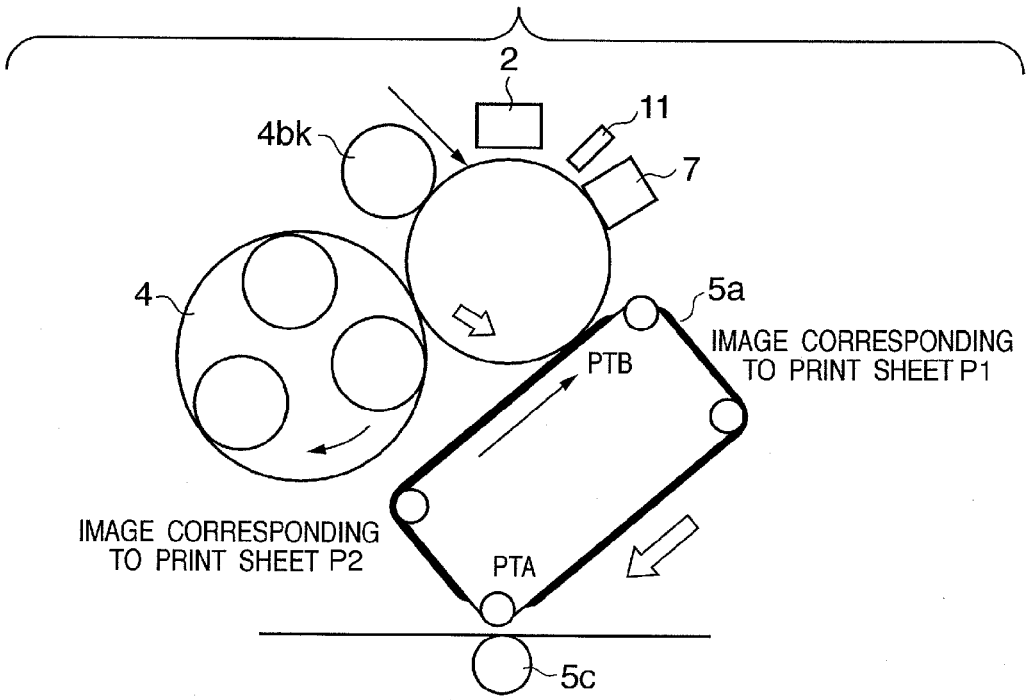

FIG. 3A depicts a view illustrating how an image is formed on the intermediate transfer belt 5*a* under the 1-sheet forming control. FIG. 3B depicts a view illustrating how images are formed on the intermediate transfer belt 5*a* under the 2-sheets forming control.

Under the 1-sheet forming control, a toner image is transferred to the intermediate transfer belt 5*a* starting from a fixed point PTA on the belt 5*a*. In this case, control is performed such that an image is always transferred that its leading edge corresponds to a fixed point PTA on the intermediate transfer belt 5*a* regardless of the size of a print sheet relative to the direction in which the intermediate transfer member 5*a* is rotated (the form of a toner image with respect to a print sheet P1).

Under the 2-sheets forming control, a toner image corresponding to the first transfer material is transferred so that its leading edge corresponds to the fixed point PTA on the intermediate transfer belt 5*a* as is the case with the 1-sheet forming control (the form of a toner image with respect to a print sheet P1). A toner image corresponding to the second transfer material is transferred so that its leading edge corresponds to a fixed point PTB on the intermediate transfer belt 5*a* which is located 180° from the fixed point PTA with respect to the center (the form of a toner image with respect to a print sheet P2). Thus, under the 2-sheets forming control, toner images are transferred to the intermediate transfer belt 5*a* so that their leading edges correspond to the fixed point PTA or PTB regardless of the size of the print sheet, as is the case with the 1-sheet forming control. The following control is hereinafter referred to as face-A imaging or face-A forming control: a toner image is transferred so that its leading edge corresponds to the fixed point PTA. The following control is hereinafter referred to as face-B imaging or face-B forming control: a toner image is transferred so that its leading edge corresponds to the fixed point PTB.

Rotation of the belt-like transfer member, that is, the intermediate transfer member 5*a*, allows the toner images for the respective colors on the photosensitive drum 1 to be transferred to the intermediate transfer member 5*a* via the primary transfer roller 5*b*. This allows a desired number of color images to be transferred to the intermediate transfer member 5*a* so that the respective color images overlap one another to form a full-color image. For a full color image, after four color toner images are thus transferred to the intermediate transfer member 5*a*, a print sheet transferred from a sheet feeding cassette 70 is conveyed to a secondary transfer roller 5*c*, where a secondary transfer is executed on the print sheet the print sheet on which the four color toner images have been transferred passes through the secondary transfer roller 5*c* and is then discharged to a sheet discharging unit via a thermal roller fixer 9. The sheet feeding cassette 70 has print sheet cassettes 7*a*, 7*b*, 7*c*, and 7*d* that can accommodate print sheets of different sizes but that may accommodate print sheets of the same size.

A drum cleaning unit 7 cleans the residual toner on the surface of the photosensitive drum 1 on which the primary transfer has been executed. The photosensitive drum 1 is ready to the subsequent image forming step. On the other hand, the cleaning unit 6 cleans the residual toner on the surface of the intermediate transfer member 5*a* on which the secondary transfer has been executed. The intermediate transfer member 5*a* is then ready to the subsequent image forming step.

To form images on both sides of the print sheet, the print sheet on which an image has been formed on one side is discharged from the fixer 9 and a conveying path switching guide 19 is immediately driven to change the direction in which the print sheet is conveyed. This allows the print sheet to be guided to a reversal path 21*a* through a conveying vertical path 20. A reversal roller 21*b* is then reversed to convey the print sheet out of the reversal path 21*a* in the direction opposite to the one in which the sheet was guided into the reversal path 21*a* so that the end of the sheet which corresponded to its tail when it was guided into reversal path 21*a* now serves as the leading edge. The print sheet is then housed in a double side path 22. The above image forming step is subsequently executed to feed the print sheet to the secondary transfer roller 5*c* again, where an image is formed on the other side. If images are thus formed on both sides of the print sheet, the first side of the print sheet on which an image is formed first is called the "first side". The second side of the print sheet on which an image is formed next time is called the "second side".

In the present embodiment, an eccentric cam 25 is actuated at a desired timing to operate a cam follower integrated with the secondary transfer roller 5*c*. This enables the gap between the intermediate transfer member 5*a* and the secondary transfer roller 5*c* to be arbitrarily set. For example, during standby state or power-off, the intermediate transfer member 5*a* is separate from the secondary transfer roller 5*c*.

Description will be given of a reference signal for the intermediate transfer member for control of an image forming operation.

For the forming control under which an image is formed on the intermediate transfer member 5*a* so that its leading edge corresponds to the fixed point PTA as described above with reference to FIGS. 3A and 3B, a sensor (not shown) and a sensor detection flag are arranged on the intermediate transfer member 5*a* in order to align the color toner images with one another.

Figure 4:
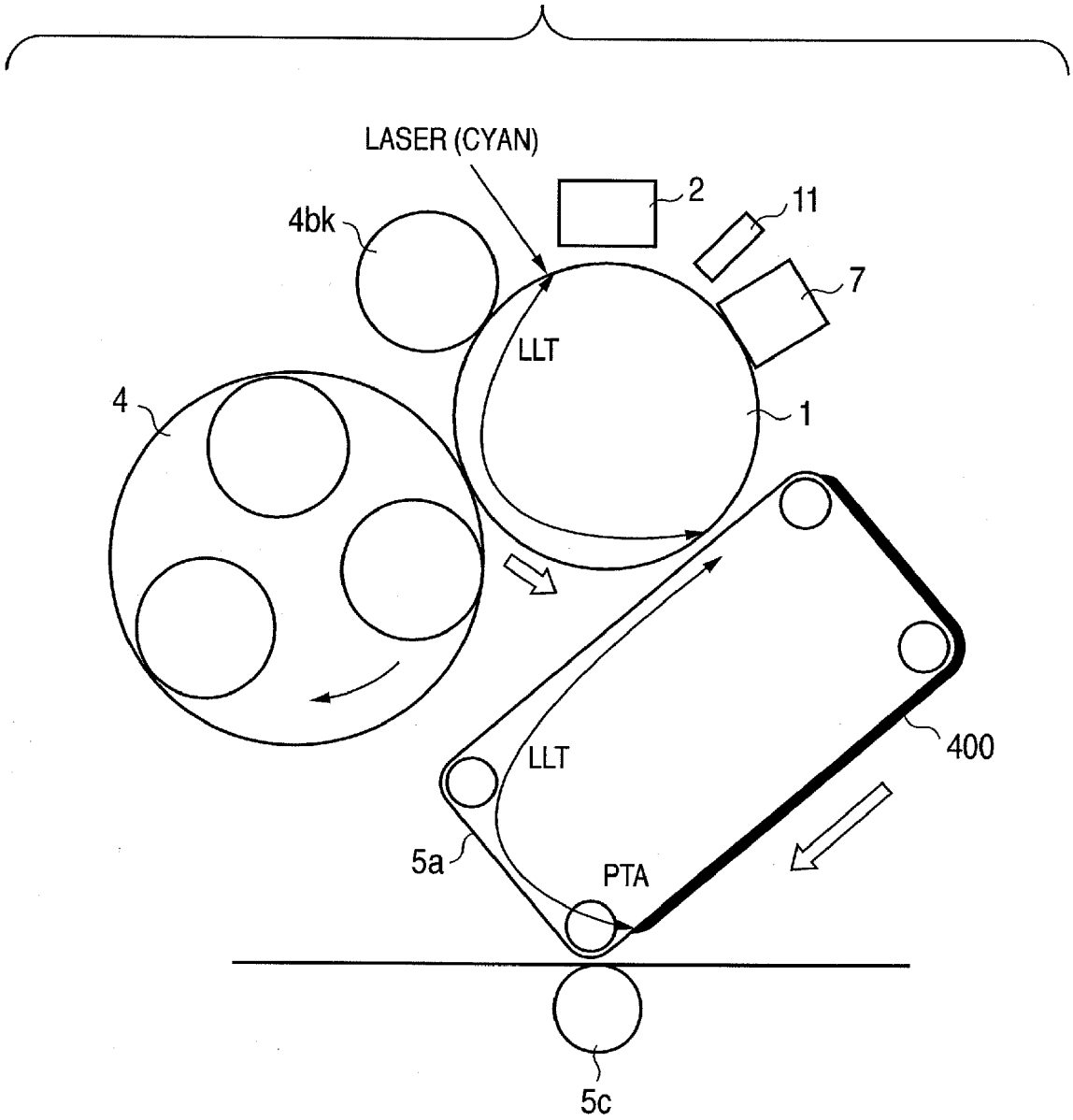
FIG. 4 depicts a view showing how a photosensitive drum and an intermediate transfer member operate immediately after the start of formation of a latent image according to the embodiment of the present invention.

FIG. 4 depicts a view showing how the photosensitive drum 1 and intermediate transfer member 5*a* operate immediately after the start of latent image formation. This figure shows that during a transfer to a print sheet, the leading edge of an electrostatic latent image on the intermediate transfer member 5*a* overlaps the leading edge of the print sheet.

Figure 5:
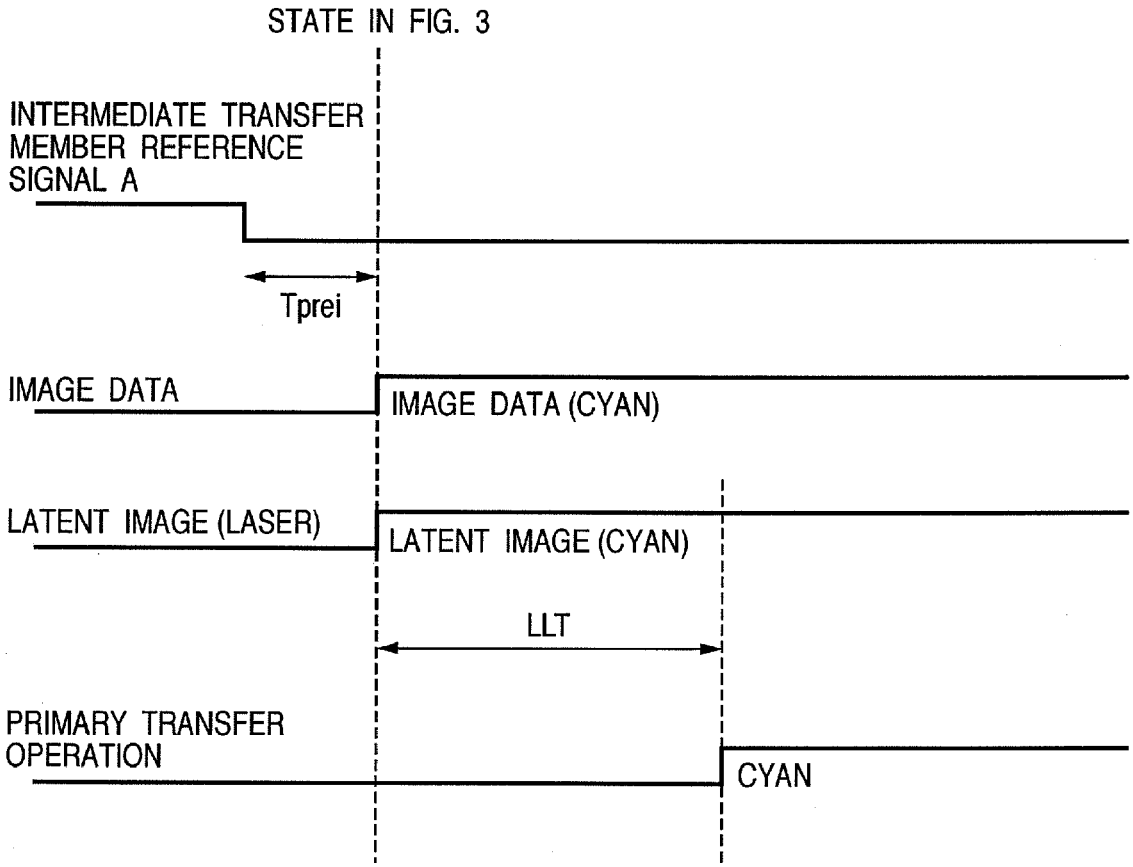
FIG. 5 is a timing diagram showing the relationship between a forming of an electrostatic latent image (laser) and an intermediate transfer member reference signal according to the embodiment of the present invention.

In contrast, FIG. 5 depicts a timing duagram explaining the relationship between a forming of an electrostatic latent image (laser) and an intermediate transfer member reference signal A. This figure shows that the intermediate transfer member reference signal A falls a time Tprei before a latent image formation start timing. A similar signal is provided for the B-side control and is called an intermediate transfer member reference signal B (hereinafter referred to as ITOP-B). The intermediate transfer member reference signals A and B are generated during rotation of the intermediate transfer member 5*a*. As described later, a driving motor for the photosensitive drum 1 can drive the drum 1 at plural types of speeds corresponding to a fixation speed.

Now, description will be given of toner concentration control in the developing unit 4.

The toner in the magenta developer 4*m*, cyan developer 4*c*, and yellow developer 4*y* reflects near infrared light of wavelength about 960 nm. This characteristic is thus utilized to irradiate a toner image developed on the intermediate transfer member 5*a* with near infrared light. A reflection component from the intermediate transfer member 5*a* is compared with direct light from an irradiation light source on the basis of a digital signal resulting from a conversion, by an A/D converter 219, of a signal from the light amount sensor 13 in the intermediate transfer member 5*a*. The toner concentration is detected on the basis of the density of a developed toner image. On the basis of the toner concentration, the concentration of the toner in the developer is calculated. For the black toner, an amount of toner corresponding to the toner concentration signal is supplied from a hopper (not shown) to the developer. For the yellow, magenta, and cyan toners, an amount of toner corresponding to the toner concentration signal is supplied from a toner cartridge (not shown) to the developer.

Now, the thermal roller fixer 9 will be described.

The thermal roller fixer 9 has a fixing upper roller 9*a*, a fixing lower roller 9*b*, and a fixing web 9*c*. The thermal roller fixer 9 uses the thermal energy of the fixing rollers 9*a* and 9*b* to melt the toner on the print sheet. The melted toner is fixed to the print sheet under the pressure between the fixing rollers 9*a* and 9*b*. The surfaces of the fixing upper roller 9*a* and fixing lower roller 9*b* are independently controlled to optimum surface temperatures by a fixing upper heater 9*e* and a fixing lower heater 9*f* incorporated in substantially central parts of the respective rollers as well as fixing upper and lower thermistors that detect the surface temperatures of the respective rollers.

The fixing web 9*c* is abutted against the fixing upper roller 9*a* as required in order to remove stains on the fixing upper roller 9*a* or offset toner. On this occasion, a winding device contained in the fixing web 9*c* can abut a new surface of the fixing web 9*c* against the fixing upper roller 9*a* to improve cleaning performance.

In the thermal roller fixer 9, a fixation motor (not shown) drives the fixing rollers 9*a* and 9*b* and a print sheet conveying unit. The fixation motor is driven by a fixation motor driver. The present embodiment can realize fixation speeds corresponding to the four types of print sheets in order to eliminate the difference in fixability among the print sheet types.

When the specific peripheral speed of the photosensitive drum 1 during image formation is defined as VP (hereinafter referred to as a process speed), the speed VFN at which the toner is fixed to ordinary paper is equal to the VP. The fixing speed VFD for the second side is lower than the VFN. The fixing speed VFT for card boards is lower than the VFD. The fixing speed VFO for OHP is lower than the VFT. Consequently, the relationship VP=VFN>VFD>VFT>VFO is established. The fixation motor driver is configured to be able to realize the four types of fixation speeds. The conveying speed of the print sheet conveying unit is set equal to the peripheral speed of the fixing rollers 9*a* and 9*b*. The fixing speed VFD for the second side is used for the second side to which two or more color toners are fixed and is not used in a monochromatic mode in which only one color toner is fixed even to the second side. In the latter case, the fixing operation is performed at the fixing speed VFN for an ordinary paper.

FIG. 2 is a block diagram showing the configuration of the color image forming apparatus according to the present embodiment.

A reader controller 200 controls the operation of the reader unit 101 and connects to a ROM 204 that stores data and control programs executed by a CPU 200*a* of the reader controller 200, a RAM 205 that temporarily stores various data such as image data, a DF control unit 206 that controls the operation of the ADF 100, a motor driver 207 that drivingly conveys an optical unit on which the light source 32 and the like are mounted, a CCD driver 208 that drives the image pickup device (CCD) 34, an I/O port 209, and the like.

The image processing unit 203 is interposed between the reader unit 101 and the printer unit 102 to process image data input by the reader unit 101 and then to output the processed data to the printer unit 102. The image processing unit 203 is also connected to an image memory 202 and an external IF processing unit 210 that controls an interface to an external apparatus. The image memory 202 has a page memory unit 211 that stores image data for one page, a memory controller unit 212 that controls accesses to the image memory 202, a compression/decompression unit 213 which compresses and stores image data in an HD 214 and which decompresses compressed data read from the HD 214, and the hard disk (HD) 214 that stores the image data compressed by the compression/decompression unit 213.

Now, the control of the printer unit 102 will be described. A printer controller 201 controls the operation of the entire printer unit 102. The printer controller 201 connects to a ROM 217 that stores data and control programs executed by a CPU 201*a* of the printer controller 201, a RAM 218 that temporarily stores various data such as image data, the A/D converter 219 to which analog signals from sensors and the like are input and which converts these analog signals into digital signals, a D/A converter 220 that converts a digital signal into an analog signal in order to control a high-voltage power source 222 that controls a high voltage for the fixer 9 or the charger 2, an I/O port 221 that outputs driving signals to motor drivers, a sorter controller 215 that controls a sorter in which printed sheets are accommodated, a laser driver 216 that drives a semiconductor laser to emit laser light corresponding to an image signal, and the like. A fixing thermistor 230 is a temperature sensor that detects the temperature of the heating fixing roller 9*a* of the fixer 9. A potential sensor 231 detects the output potential of the high-voltage power source 222. A temperature sensor 232 and a humidity sensor 233 detect the environment in which the image forming apparatus is placed. The density sensor 13 detects the density of a toner image on the intermediate transfer member 5*a* as previously described. Detection signals from these sensors are converted into digital signals by the A/D converter 219. The digital signals are then input to the printer controller 201, serving as a density adjusting unit. On the basis of the digital signals, the printer controller 201 detects temperature, potential, density, and the like to control operations.

Motor drivers described below are connected to the I/O port 221. A rotational-developing-unit motor driver 235 drives a motor that rotates the rotational developing unit 4 in order to change an electrostatic latent image on the photosensitive drum 1 to a toner image of the desired color. A drum motor driver 236 drives a motor that rotates the photosensitive drum 1. A sheet feeding motor driver 237 rotationally drives a pickup motor that allows a print sheet to be taken out of a sheet feeding cassette and conveying motors that allow a print sheet to be conveyed. A secondary-transfer-roller removable motor driver 238 drives a motor that contacts or separates the secondary transfer roller 5*c* with or from the intermediate transfer member 5*a* as previously described. An intermediate-transfer-member-cleaner removable motor driver 239 drives a motor that contacts (for cleaning) or separates the cleaning unit 6 with or from the intermediate transfer member 5*a* as previously described.

Figure 6:
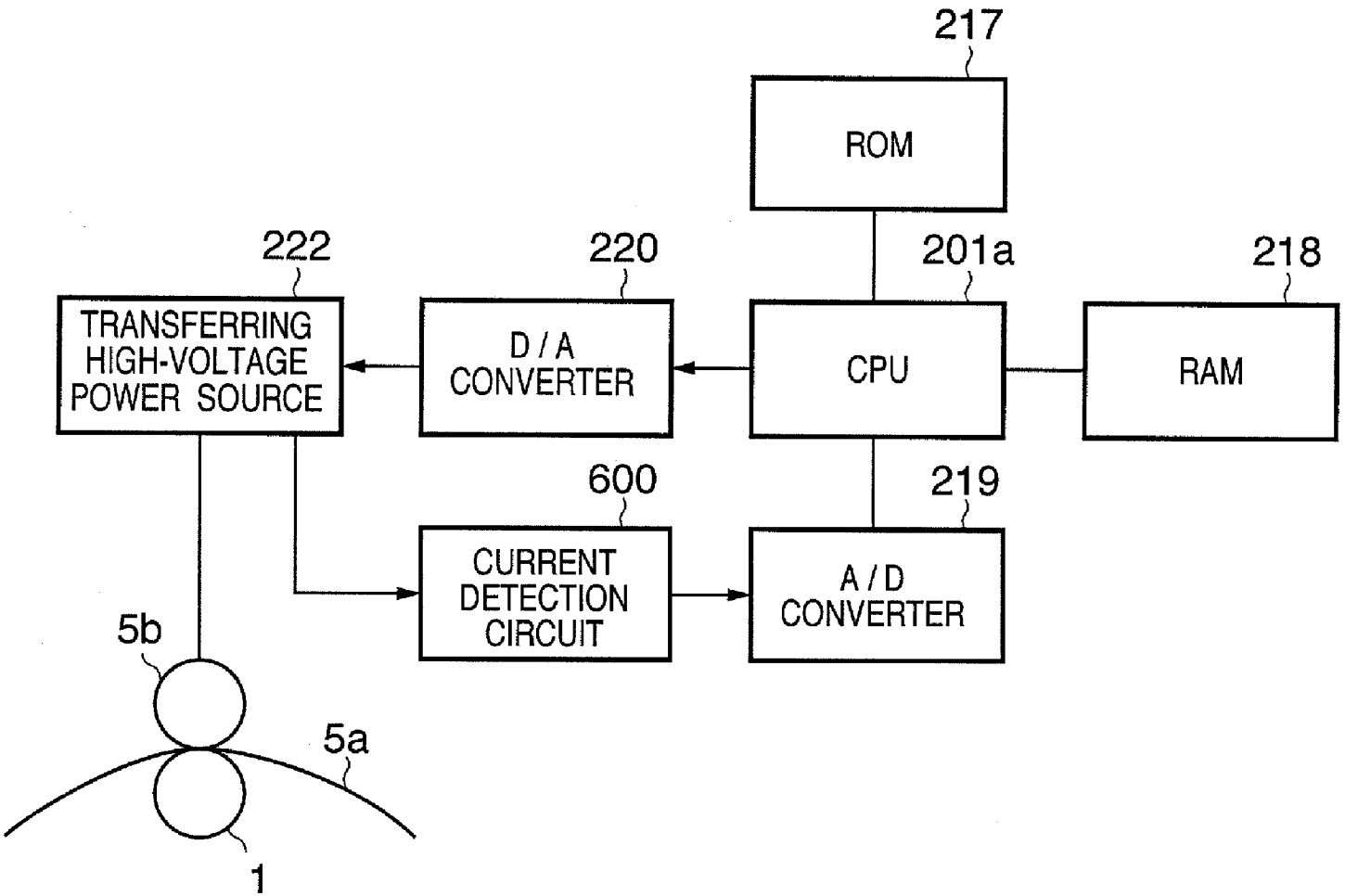
FIG. 6 is a block diagram showing an arrangement that controls a primary transfer high voltage for a printer portion according to the present embodiment.

FIG. 6 is a block diagram showing an arrangement that controls a high voltage for a primary transfer in the printer unit 102 according to the present embodiment. Those components in FIG. 6 which are common to FIG. 2, previously described, are denoted by the same reference numerals and will not described.

The CPU 201*a* of the printer controller 201 serves as a transfer voltage determining unit to control a high voltage for transfer. Control data (00 to FF: hexadecimal numbers) output by the CPU 201*a* and input to the D/A converter 220 controls the transferring high-voltage power source 222 depending on the value of the data. In this case, an output from the D/A converter 220 is converted into a control signal of 0 to 12 V, which causes the transferring high-voltage power source 222 to apply a voltage of −4 to +8 kV to a primary-transfer opposite roller. This voltage sets a transfer current flowing from the primary-transfer opposite roller to the primary transfer roller 5*b*, within the range from −40 to +100 μA. This current value is detected by a current detection circuit 600. The thus detected current value is converted into a digital signal by the A/D converter 219. The CPU 201*a* captures the digital signal to execute a mathematic process for ATVC.

Description will be given of a specific example of image formation based on the above configuration.

Description will be given of formation of a four color image on ordinary paper in a mode in which the image on one side of an original for which the auto document feeder ADF 100 is not used is printed on one side of a print sheet. In this case, since the print sheet on which images are formed is an ordinary paper, the fixation motor is set for the speed VFN, which is the same as the image forming speed (process speed) VP of the photosensitive drum 1.

After setting the number of sheets for image formation via an operation unit (not shown), the operator selects one of the sheet feeding stages (7*a* to 7*d* or manual feeding) in which ordinary paper used for the image formation is accommodated and instructs a copy operation to be started. The printer controller 201 instructs drivers 235 to 237 for driving for the driving motors required for image formation, for example, the drum driving motor, fixation motor, sheet feeding driving motor, and main driving motor. Once the driving state of these driving motors is stabilized, an operation of feeding ordinary paper from the specified sheet feeding stage (print sheet cassette 7*a*, 7*b*, or the like) is started. An original image read in by the reader unit 101 is separated into four colors by the image processing unit 203. The processed digital image data is then transferred to the printer unit 102.

Image formation on the intermediate transfer member 5*a* is executed by sending the color-separated image data from the image processing unit 203 to the printer unit 102 in synchronism with a reference signal for the intermediate transfer member 5*a*. The ordinary paper fed from the specified sheet feeding stage is conveyed by the registration roller 50 at an appropriate timing for a reference position on the intermediate transfer member 5*a*. The secondary transfer roller 5*c* transfers the image to a predetermined position on the ordinary paper.

FIG. 4, previously described, shows the positional relationship between the photosensitive drum 1 and the intermediate transfer member 5*a* at a latent-image write start timing. This figure shows 1-sheet face-A forming control under which an image 400 corresponding to a print sheet A is temporarily transferred starting from the fixed point PTA on the intermediate transfer member 5*a*. In the present embodiment, a full color image is formed in the order of magenta, cyan, yellow, and black. This figure thus corresponds to the case in which for example, magenta has been primarily transferred and in which a cyan latent image has started to be written to the photosensitive drum 1. Processing is subsequently executed over the distance LLT from laser write position to primary transfer position on the drum 1, at the process speed VP. After the corresponding time has elapsed, an operation of primarily transferring a cyan toner image is started.

FIG. 5 is a timing chart of FIG. 4, illustrating the relationship between image forming operations and an intermediate transfer member reference signal on which the timing control according to the present embodiment is based.

Forming of an electrostatic latent image in the image processing unit 203 is started after a time period Tprei after a fall of the intermediate transfer member reference signal A. The intermediate transfer member reference signal A is also used to determine a timing for a primary transfer operation started at an LLT after the start of forming of the latent image.

Figure 7:
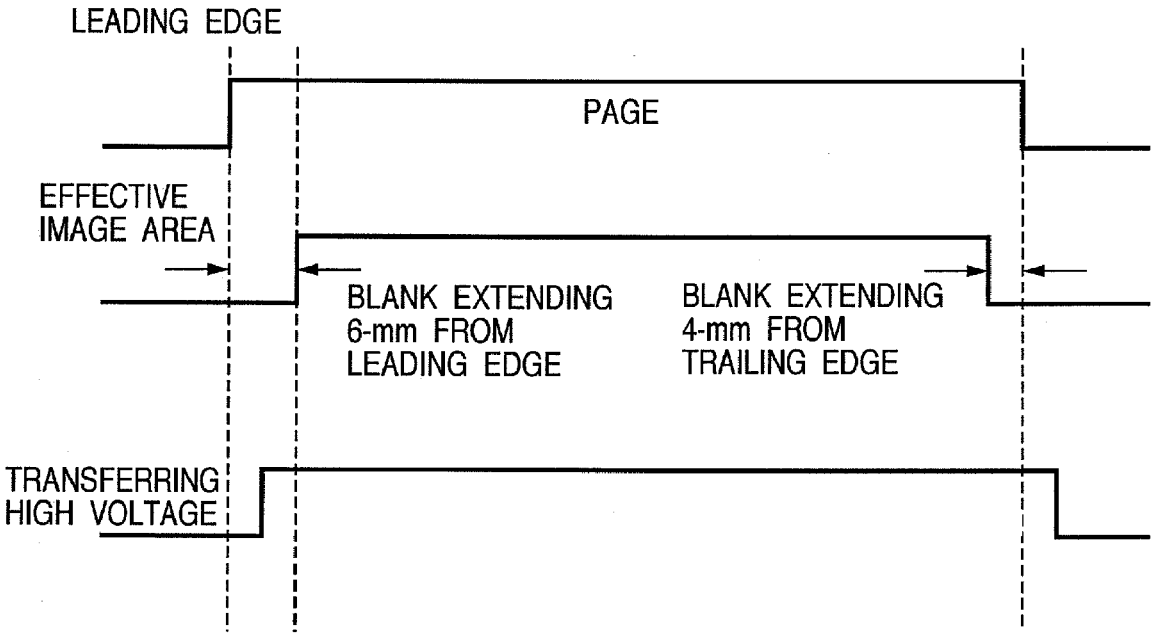
FIG. 7 is a diagram of timings required for image formation according to the present embodiment and which are represented as timings with respect to a print sheet so as to make the arrangement of a control portion negligible.

FIG. 7 is a timing diagram showing timings required for image formation and represented with respect to the print sheet so as to make the location of the control area negligible.

When an image is formed on the intermediate transfer member 5*a*, image data is output taking into account the absence of the image in areas 6 and 4 mm from the leading and trailing edges, respectively, of the print sheet. The image data output area is shown as an effective image area. The areas at the leading and trailing edges are required to prevent the interior of the apparatus from being contaminated with falling toner between secondary transfer and fixation. The transferring high voltage required for the secondary transfer operation rises at a position 6 mm from the leading edge of the print sheet. The transferring high voltage falls at a position beyond the entire area of the print sheet.

Original image information sent by the reader unit 101 is processed by the image processing unit 203 and converted into a laser driving signal. Laser light is drivingly modulated in accordance with the laser driving signal and then applied to the photosensitive drum 1 uniformly charged by the charger 2. An electrostatic latent image is thus formed on the surface of the photosensitive drum 1. The electrostatic latent image is first developed by the magenta developer 4*m*. Accordingly, the first electrostatic latent image formed is based on the color image data on the magenta component. The thus developed magenta toner image is transferred to a predetermined position on the intermediate transfer member 5*a* by the primary transfer roller 5*b*. The image forming operation is performed during one rotation of the photosensitive drum 1 and intermediate transfer member 5*a*; the image forming operation consists of the formation, development, and transfer of the M (magenta) electrostatic latent image. Image formation is similarly executed for each of the remaining three colors, C (cyan), Y (yellow), and Bk (black). Setting an image forming process in the image process unit 203 is executed for each color.

The four-color toner image primarily transferred to the intermediate transfer member 5*a* is secondarily transferred by the secondary transfer roller 5*c* to the print sheet conveyed by the registration roller 50 in accordance with the timing suitable for the secondary transfer. On this occasion, the secondary transfer roller 5*c* applies secondary-transfer high voltage to between the intermediate transfer member 5*a* and the print sheet. A secondary transfer current is thus formed to secondarily transfer the toner image to the print sheet.

The print sheet to which the toner image has been transferred by the secondary transfer roller 5*c* is conveyed to the thermal roller fixer 9 by the conveying unit that performs a conveying operation at the same speed (VP) as that of the intermediate transfer member 5*a*. The fixer 9 fixes the toner to the print sheet at the fixing speed VFN=VP and then discharges the print sheet to the sorter.

Now, description will be given of the use of card boards instead of ordinary paper as print sheets.

More energy is required to fix the toner to a card board than to an ordinary paper. Thus, the fixing speed for the card board is reduced compared to that for the ordinary paper to increase the energy per unit area/time to allow the toner to be appropriately fixed to the card board. In this case, the prior art sets the distance from the secondary transfer roller 5*c* to the position of the abutment between the upper and lower fixing rollers 9*a* and 9*b*, larger than the maximum area in each card board in which an image can be formed. The prior art thus uses the print sheet conveying unit as a conversion area in which the speed is changed. Specifically, the conveying unit can reduce the conveying speed of the card board so that it is equal to the fixing speed VF different from the speed of the intermediate transfer member 5*a*, with the peripheral speed of the intermediate transfer member 5*a*, the image forming speed (process speed) VP, fixed. The print sheet conveying unit must thus have a length equivalent to the maximum allowable image formation area of the card board. This disadvantageously increases the size of the apparatus. Thus, the present embodiment is configured to vary the speed of the intermediate transfer member 5*a* similarly to the fixing speed. Specifically, to reduce the fixing speed VF below the image forming speed VP, the conveying speed for the intermediate transfer member 5*a* is reduced to be equal to the fixing speed after the completion of transfer of the final color (in this embodiment, yellow). This eliminates the need to ensure a length for the conversion area in the print sheet conveying unit, thus avoiding an increase in the size of the apparatus.

As shown in FIG. 1, the color image forming apparatus according to the present embodiment includes the rotational developing unit 4 for the three colors, Y, M, and C, and the fixed developer 4*bk* for Bk (black).

Figure 8:
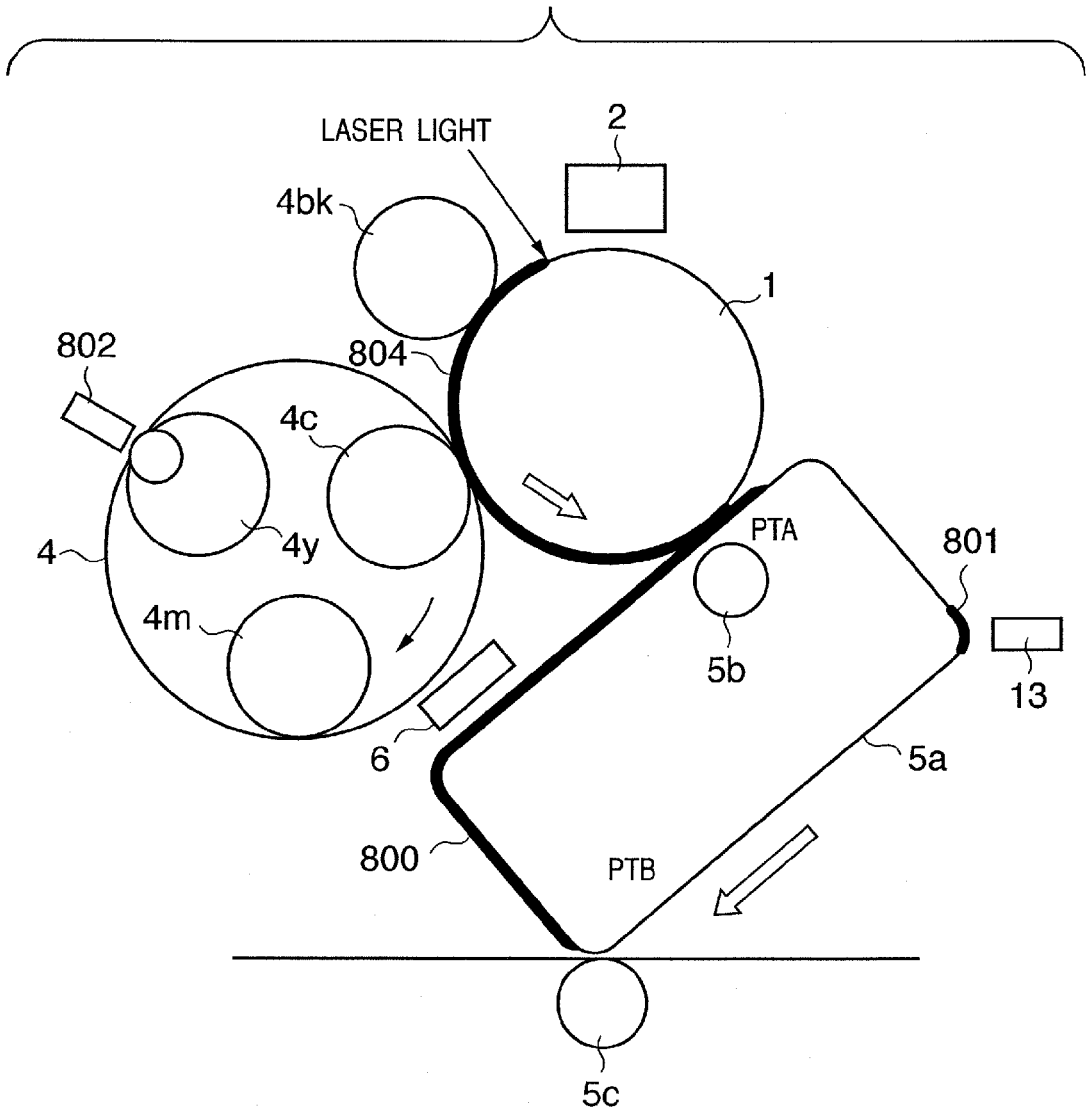
FIG. 8 depicts a view showing that a toner image of a first color, magenta, has been primarily transferred to the intermediate transfer member and that a toner image of a second color, cyan, has been formed on the photosensitive drum and started being primarily transferred to the intermediate transfer member, according to the embodiment of the present invention.

FIG. 8 depicts a view illustrating the control of the rotational developing unit 4 in the color image forming apparatus according to the present embodiment.

At the beginning of copying, the magenta developer 4*m* moves to a position where it lies opposite the photosensitive drum 1. After the first magenta image is developed, the rotational developing unit 4 is rotated until the subsequent development with the cyan toner is started. The cyan developer 4*c* is thus moved to a position where it lies opposite the photosensitive drum 1. The subsequent development with the yellow toner is similarly executed. In the figure, reference numeral 800 denotes a magenta toner image formed on the intermediate transfer member 5*a*. Reference numeral 801 denotes a magenta patch image (test patch). Reference numeral 802 denotes a non-contact ATR sensor.

The rotational position of the rotational developing unit 4 is controlled by counting the number of driving pulses for a stepping motor that is rotationally driven by the rotational-developing-unit motor driver 235. This allows the accurate control of the position where each color developer is stopped. In 2-sheets forming control, the distance between two images formed on the intermediate transfer member 5*a* is short. The rotation driving of the rotational developing unit 4 is thus controlled by high-speed rotational driving using the acceleration and deceleration of the stepping motor. The black developer 4*bk* is independently fixed and thus need not be rotationally controlled.

The color image forming apparatus according to the present embodiment has no sensor in the developer which measures the concentration of the toner. Accordingly, toner consumption is calculated on the basis of a count for image data formed into an image. The value obtained is determined to be the amount of toner supplied from the toner cartridge to the developer. The toner cartridge is provided with a screw (not shown) for supplying toner, and the amount G of toner supplied by rotating the screw for a given time is known. The relationship between a toner supply amount X and a screw rotation time t is expressed by the linear equation $X=G\cdot t$. To evenly supply toner to the developers during toner supply, the toner supply operation must be finished within the operative period of the developer. If the rotation period of the screw for toner supply exceeds the time for one developing operation, the toner supply operation is performed over two developing operations.

The toner supply control based on the count for image data formed into an image offers a substantially correct supply amount during a short period. However, possible errors prevent the actually developed toner image from being controlled on the basis of the count so as to have an appropriate density. The present embodiment thus forms images on a predetermined number of print sheets and then forms a patch image on the intermediate transfer member 5*a*. The present embodiment then measures the density of the patch image to change the toner supply amount based on the measured density. This makes up for calculation errors in the supply amount based on the count for the image data formed into an image.

The patch image is formed at the trailing edge of a normal image being formed (1-sheet forming control) as shown in FIG. 8. The patch image is primarily transferred to the intermediate transfer member 5*a*. The reflection light amount sensor 13 installed at the predetermined position detects the quantity of light reflected. The patch image is not secondarily transferred to the print sheet. After the normal image part is transferred to the print sheet, the cleaning unit 6 cleans the intermediate transfer member 5*a* of the toner image.

Now, formation of the patch image will be described with reference to FIG. 8, previously described.

The present embodiment forms the patch image during the formation of a full-color (four-color) image. FIG. 8 shows that the first magenta toner image 800 has been primarily transferred to the intermediate transfer member 5*a* and that a second cyan toner image 804 has been formed on the photosensitive drum 1 and has started to be primarily transferred to the intermediate transfer member 5*a*. In this case, an electrostatic latent image of the patch image is formed on the photosensitive drum 1 after the first magenta image is formed and before the second cyan image is formed. The magenta developer 4*m* develops the patch image to primarily transfer it to the intermediate transfer member 5*a*. The density of a magenta patch image 801 thus formed on the intermediate transfer member 5*a* is detected by the sensor 13, which measures the quantity of light reflected by the patch image. The result of the detection is input to the printer controller 201 via the A/D converter 219 and used to control toner supply. The patch images may be formed offset from one another so as not to overlap one another or may be cleaned for each color by the cleaning unit 6 if the images are formed at almost the same position.

The density correction based on the density of the patch image is executed by sampling the density of the patch image detected by the sensor 13 and comparing the density with a predetermined target density. If the density of the patch image is higher (thicker) than the target density, the toner supply amount is reduced to lower the concentration of the toner in the developing material. If the density of the patch image is lower (thinner) than the target density, the toner supply amount is increased to raise the concentration of the toner in the developing material.

[ATVC]

Now, description will be given of the ATVC for the primary transfer which is characteristic of the present embodiment. In the present embodiment, description will be given of control performed when a toner image formed on the photosensitive drum 1, serving as an image carrier, is transferred to the intermediate transfer member (intermediate transfer belt) 5*a*.

A target primary transfer current value is designed which is required to transfer a full-color (four-color) toner image to the surface of an ordinary paper serving as the print sheet under an environment of certain temperature and moisture. However, under actual control, if a transfer current larger than the target one flows during the primary transfer, the voltage applied to the primary transfer roller 5*b* increases to cause intense discharge near the primary transfer nip. This may result in discharge marks, that is, blanks in the toner image like waterdrops (transfer explosion). If a transfer current smaller than the target one flows during the primary transfer, the voltage applied to the primary transfer roller 5*b* decreases, resulting in a failure to provide a sufficient amount of charges to firmly hold the toner on the back surface of the intermediate transfer member 5*a*. This may lead to inappropriate transfer in which the toner image splashes to non-image parts (inappropriate transfer). Thus, before an image forming operation for ATVC and during a non-transfer period, an operation of measuring the transfer current is performed to measure the V-I characteristic of the primary transfer roller 5*b*.

Figure 9:
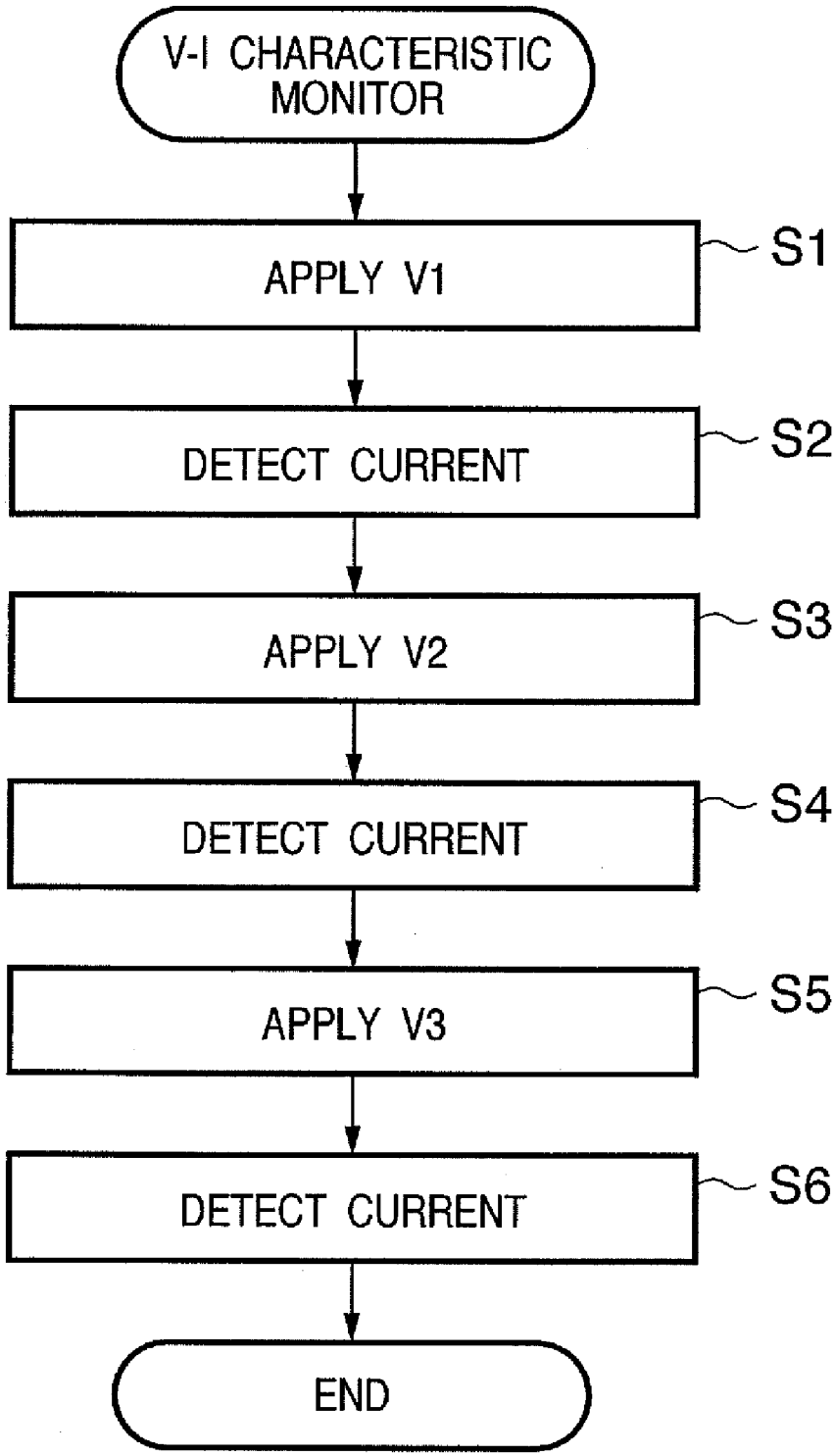
FIG. 9 is a flowchart illustrating a process of measuring the V-I characteristic of the primary transfer roller for ATVC according to the present embodiment.

FIG. 9 is a flowchart illustrating a process of measuring the V-I characteristic of the primary transfer roller 5*b* under ATVC according to the present embodiment. The period of non-transfer of a toner image refers to the absence of a toner image in the primary transfer nip portion.

First, in step S1, a voltage V1 is applied to the primary transfer roller 5*b*. Then, in step S2, a transfer current I1 is detected. The present embodiment samples the current, for example, 29 times at 20-msec intervals during one rotational period (in the present embodiment, 780 msec) of the primary transfer roller 5*b* to reduce any measurement error. The present embodiment then finds the average of the 29 values and stores it in the RAM 218. This also applies to steps S4 and S6, described later. Similarly in step S3, a voltage V2 is applied to the primary transfer roller 5*b*, and in step S4, the corresponding transfer current 12 is measured. Moreover, in step S5, a voltage V3 is applied to the primary transfer roller 5*b*, and in step S6, the corresponding transfer current I3 is measured. The present embodiment thus applies the three voltages of different levels in order to widen the measurement range to improve accuracy.

Thus, the applied voltages V1 to V3 and measured and averaged transfer currents I1 to I3 are stored in the RAM 218 in association with one another.

FIG. 10 is a diagram showing an example of a table of the V-I characteristic thus stored in the RAM 218.

In the printer unit 102 according to the present embodiment, the ideal transfer current value varying depending on the environment (humidity) is stored in the ROM 217 in table form for each color mode (color, monochromatic) and each transfer side (first side, second side).

Thus, under the ATVC, the transfer voltage is gradually raised and the transfer current corresponding to each voltage is measured. On the basis of the thus measured transfer current, the value of the voltage applied to the primary transfer roller 5*b* is determined.

Figure 11:
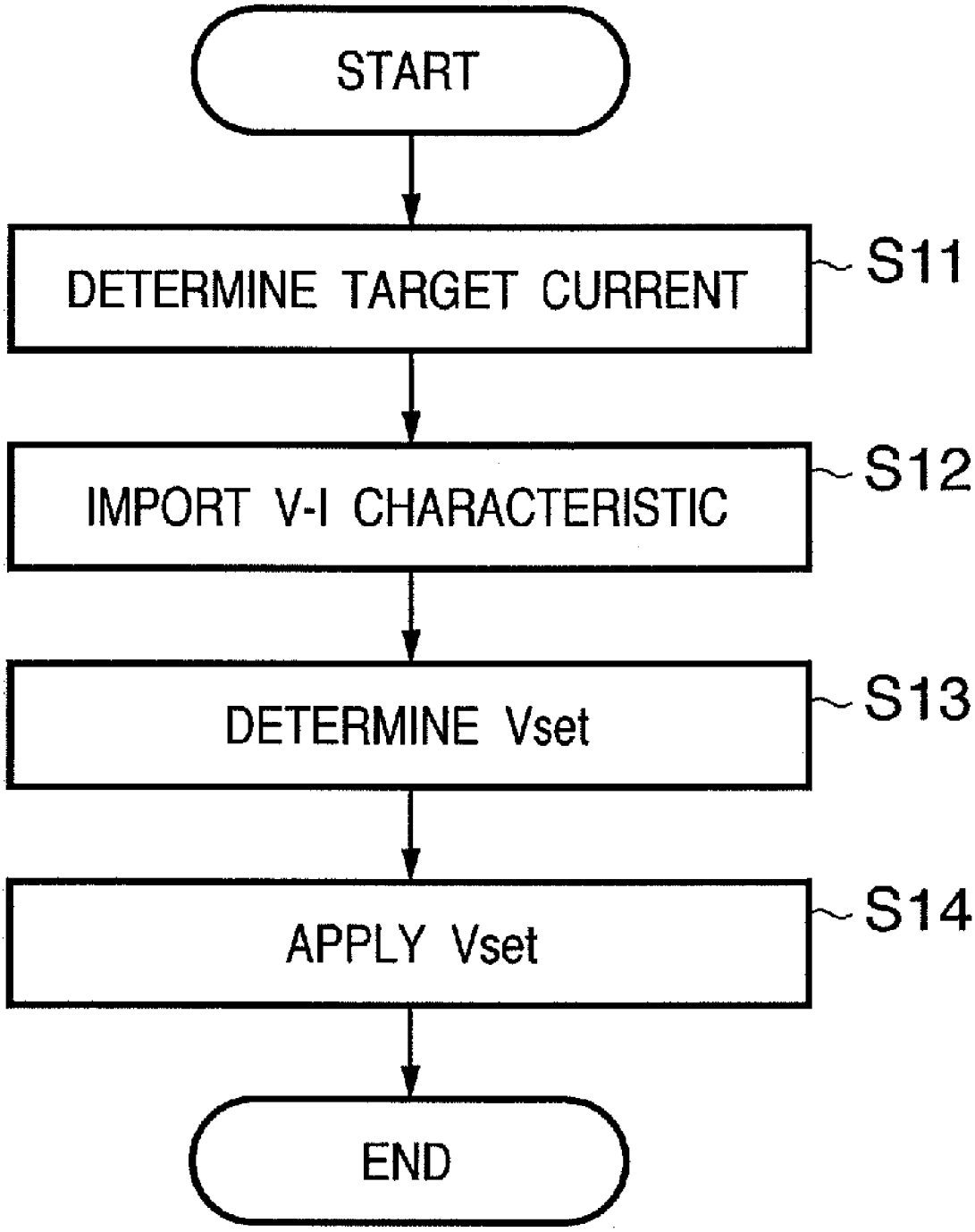
FIG. 11 is a flowchart illustrating a process of determining a transfer voltage for the color image forming apparatus according to the present embodiment.

FIG. 11 is a flowchart illustrating a process of determining the transfer voltage in the color image forming apparatus according to the present embodiment. This process is executed by the printer controller 201. A program for executing the process is stored in the ROM 217.

An instruction is given to start the ATVC. First, in step S11, a target current Itar is determined with reference to the table (not shown) stored in the ROM 217, on the basis of image formation conditions, that is, environments (the temperature and humidity of the environment), the color mode, the nature of print sheets, and the like. In step S12, the V-I characteristic values (V1 to V3 and I1 to I3) stored in the RAM 218 as described with reference to FIG. 10 are imported. In step S13, a transfer voltage Vset to be applied under the ATVC is determined. The transfer voltage Vset is determined as follows.

(1) When Itar<I2:

$$Vset=(V2-V1)(Itar-I1)/(I2-I1)+V1.$$

(2) When Itar>I2:

$$Vset=(V3-V2)(Itar-I2)/(I3-I2)+V2.$$

In step S14, the voltage Vset thus determined is applied to the primary-transfer opposite roller 5*b*.

Figure 12A:
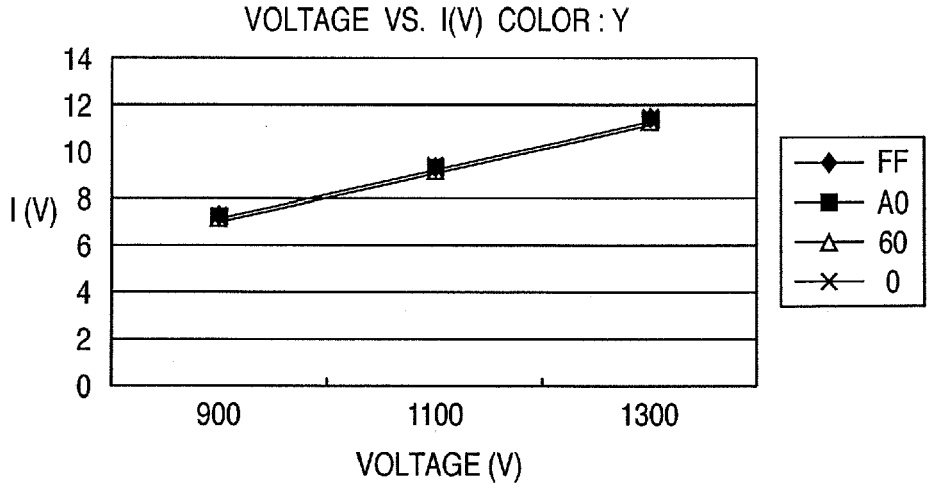
FIGS. 12A to 12C are line graphs showing the results of experiments in which a patch image for ATR control was formed while varying the transfer voltage for the primary transfer roller, with the V-I characteristic monitored, according to the present embodiment.
Figure 12B:
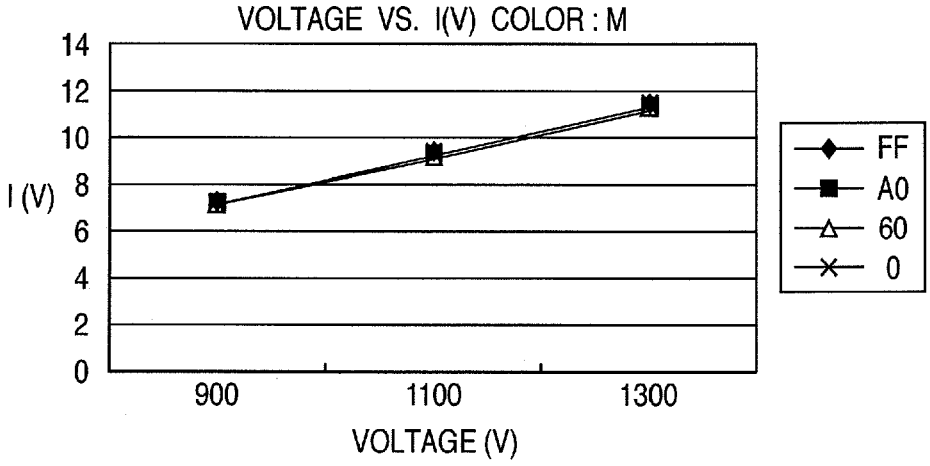
Figure 12C:
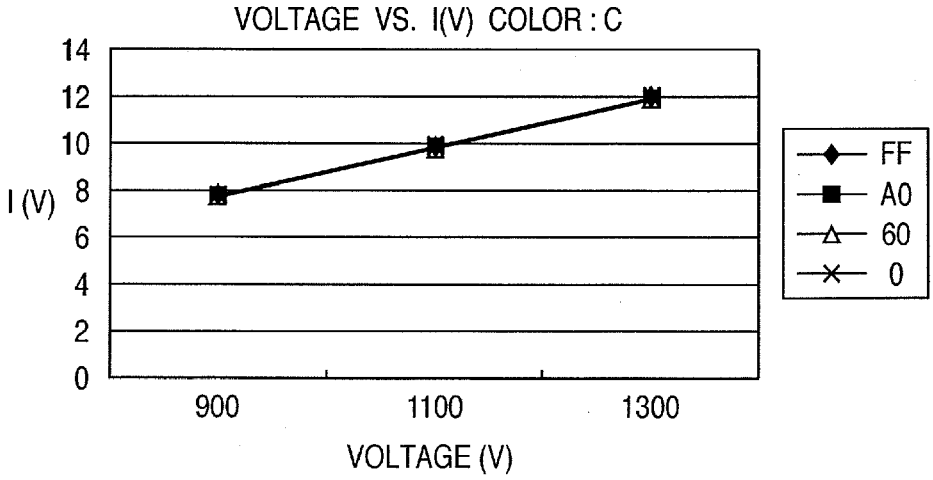

FIGS. 12A to 12C are line graphs showing the results of experiments in which a patch image for ATR control was formed while varying the transfer voltage for the primary transfer roller 5*b*, with the V-I characteristic monitored. In these figures, the density of the patch image for each color varies among four levels, "0", "0x60", "0xA0", and "0xFF"; FIG. 12A corresponds to yellow, FIG. 12B corresponds to magenta, and FIG. 12C corresponds to cyan.

FIGS. 12A to 12C indicate that the V-I characteristic of the primary transfer roller 5*b* maintains linearity in spite of the presence of the patch image and is not affected by the patch image.

Figure 13A:
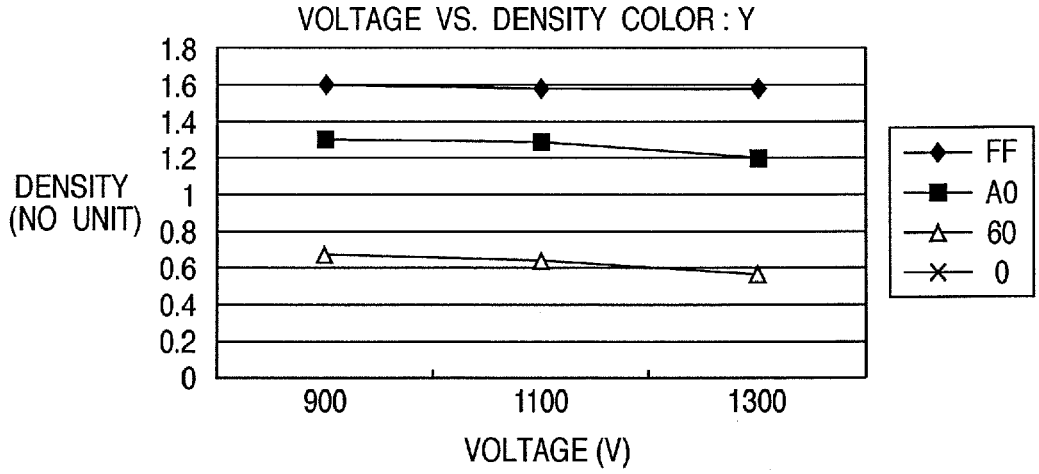
FIGS. 13A to 13C are line graphs showing the results of experiments in which a patch image for ATR control was formed while varying the transfer current for primary transfer roller for ATVC, with the density of the resulting patch image measured, according to the present embodiment.
Figure 13B:
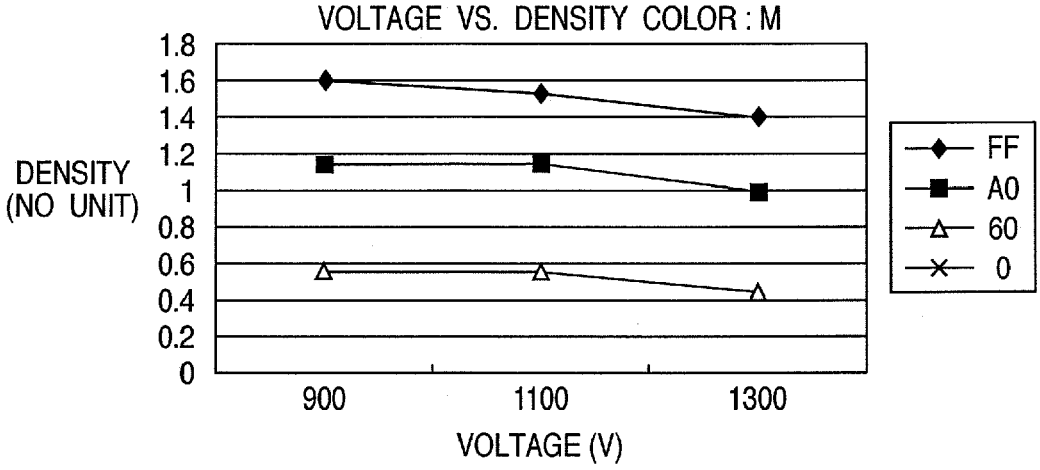
Figure 13C:
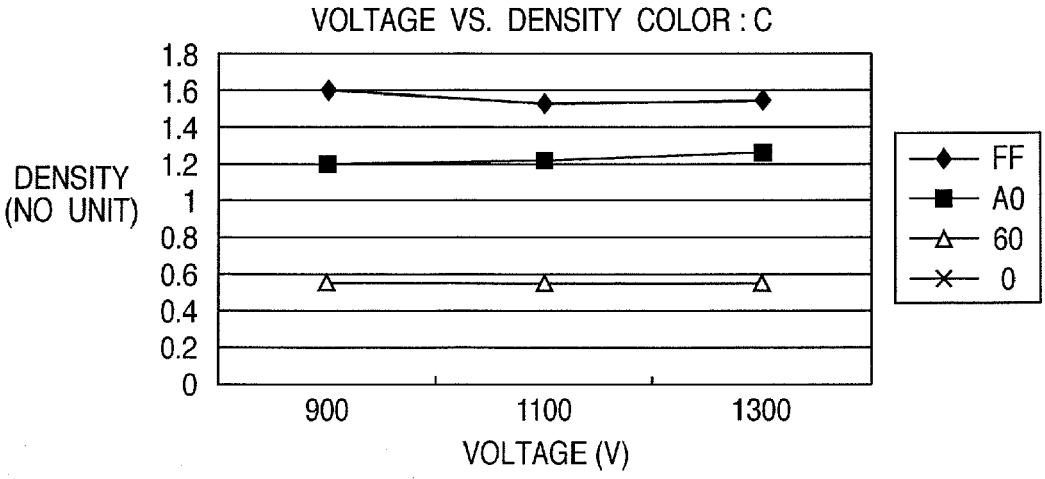

FIGS. 13A to 13C are line graphs showing the results of experiments in which a patch image for ATR control was formed while varying the transfer current for the primary transfer roller 5*b* for the ATVC, with the density of the resulting patch image measured. In these figures, the density of the patch image for each color varies among four levels, "0", "0x60", "0xA0", and "0xFF"; FIG. 13A corresponds to yellow, FIG. 13B corresponds to magenta, and FIG. 13C corresponds to cyan.

FIGS. 13A to 13C indicate that the density of the test patch image varies by 0.1 to 0.2 even with a variation in the transfer current flowing through the primary transfer roller 5*b*. This variation falls within the measurement error range (is equivalent to the amount of errors that may occur when only the patch ATR control is performed) and thus does not affect actual images.

However, the extended operative period of the photosensitive drum 1 of the image forming apparatus may wear and degrade the surface of the drum 1 to reduce the tolerance of the photosensitive drum 1 to a variation in transfer current. This makes the density of the patch image more likely to be affected by a variation in transfer current. Similarly, when the image forming apparatus is used in a cold and low-humidity environment, the tolerance of the photosensitive drum 1 temporarily decreases. Therefore, the simultaneous performance of the patch ATR and ATVC is expected to hinder the correct ATR control depending on the conditions of the image forming apparatus.

The present embodiment thus simultaneously performs the patch ATR and ATVC only during the interval in which the formation and sampling of a patch image can be executed in parallel with the ATVC. Since the density of the patch image is more likely to be affected by a smaller transfer current, when the transfer voltage is set at a smaller value, the timings for these control operations are offset from each other so as to prevent simultaneous performance. The amount of offset is characterized by being determined on the basis of the degradation of the photosensitive drum 1 and the temperature and humidity environments of the image forming apparatus.

These control processes can be performed in parallel regardless of the conditions of the image forming apparatus. This enables a reduction in the time required for auto adjustments.

Now, the control according to the present embodiment will be described with reference to the flowchart in FIG. 14. The operations are controlled by the printer controller 201, serving as a determination unit and a control unit.

First, in step S21, timing offset times in steps S22 and S23 are determined. On the basis of the offset amounts determined, the operations in steps S22 and S23 are performed in parallel.

Figure 14:
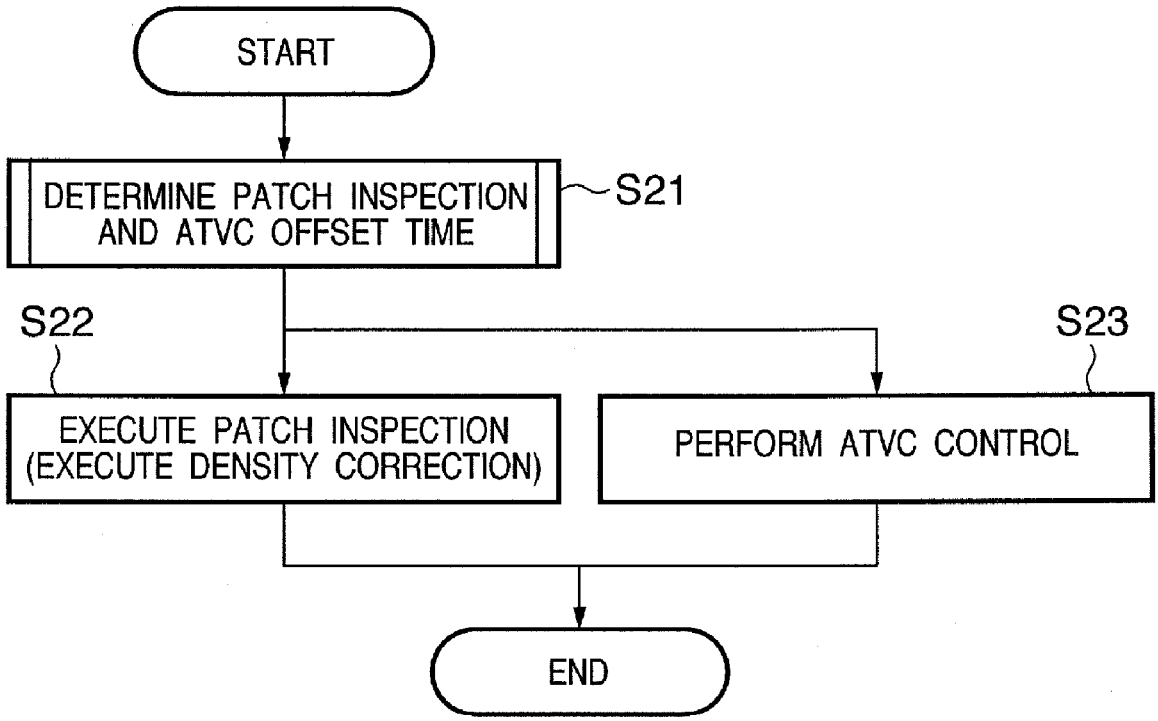
FIG. 14 is a flowchart illustrating a parallel process of patch detection and ATVC according to the present embodiment.
Figure 15:
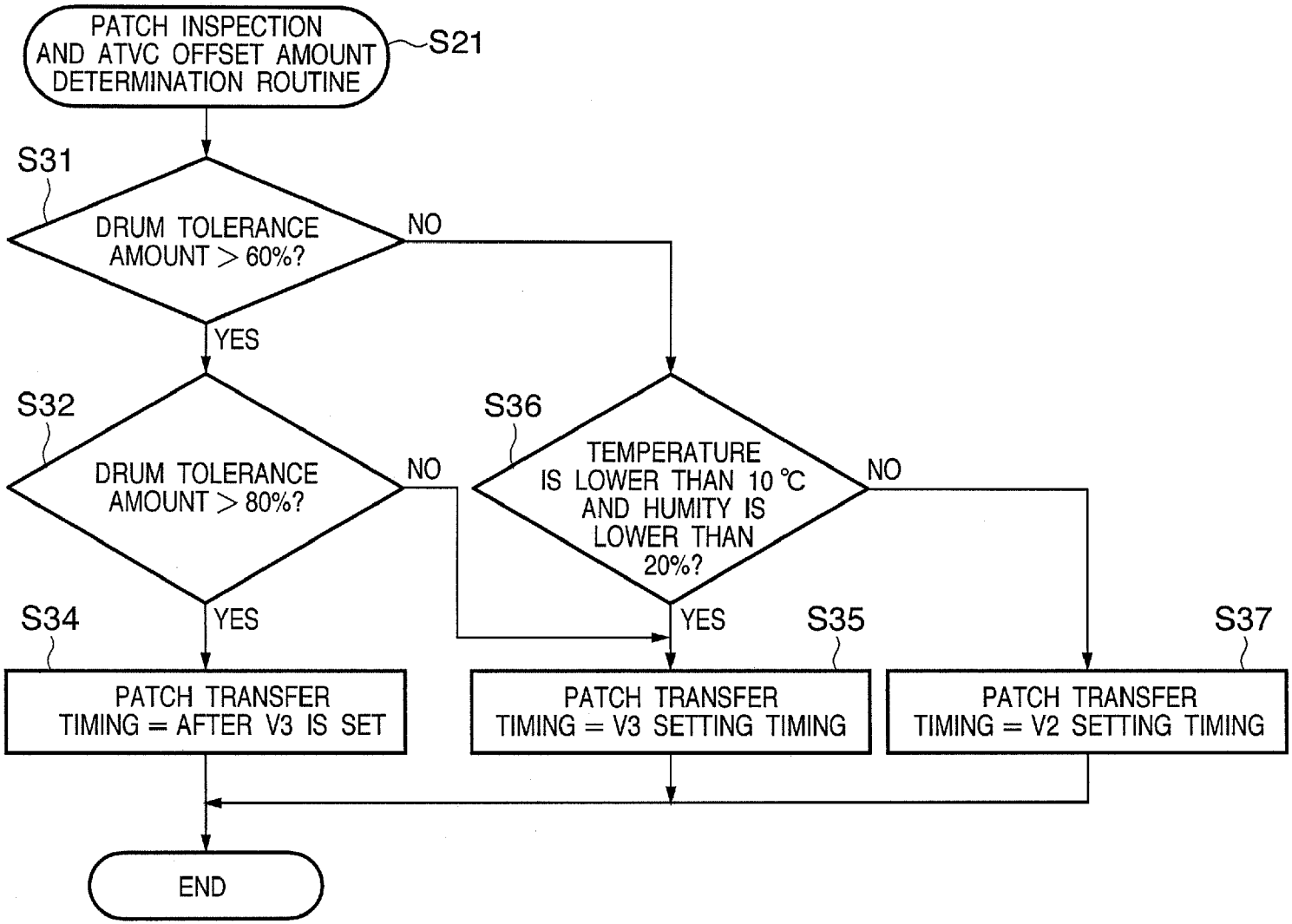
FIG. 15 is a flowchart illustrating a process of determining the offset time between ATVC and patch image formation and sampling in step S21 in FIG. 14.

FIG. 15 is a flowchart illustrating the operation of determining the offset time between the ATVC and the formation and sampling of a patch image, which operation is performed in step S21 in FIG. 14.

First, in step S31, it is determined whether or not the level of degradation of the photosensitive drum 1 accounts for more than 60% of the lifetime value. Although not shown in the drawings, the level of degradation is calculated from the total time for which a high voltage is applied to the photosensitive drum 1. The level is then determined on the basis of the rate of the application time assumed for the lifetime value, made up by the total high-voltage application time. If the level of degradation is determined to be higher than 60%, the process proceeds to step S32 to determine whether or not the level is higher than 80%. If the level is determined to be higher than 80% in step S32, the image transfer tolerance of the photosensitive drum 1 to a variation in transfer voltage is expected to be significantly degraded. Thus in step S34, the offset time is determined so that the patch image is transferred to the intermediate transfer member 5*a* immediately after the transfer voltage has been set for the ATVC.

If the drum degradation level is determined to be higher than 60% and at most 80%, the process proceeds to step S35 to set the offset amount such that the patch image is transferred to the intermediate transfer member 5*a* at the same time when the ATVC transfer current is set at the value V3.

If the drum degradation level is determined to be less than 60% in step S31, the process proceeds to step S36 where the environmental sensors (temperature and humidity sensors 232 and 233) detect the current environment of the image forming apparatus. If the environment is cold and humid, the tolerance of the drum is expected to be temporarily degraded. Thus in step S35, the offset time is set equal to the timing at which the ATVC transfer current is set at the value V3. If a different environment is determined in step S36, the process proceeds to step S37 to set the offset amount such that the patch image is transferred to the intermediate transfer member 5*a* at the same time when the ATVC transfer current is set at the value V2.

Figure 16A:
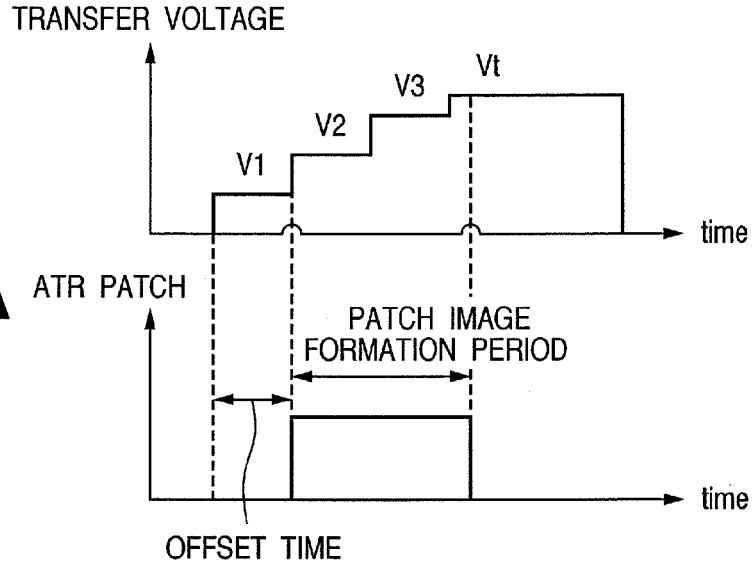
FIGS. 16A to 16C are supplementary diagrams illustrating a process shown in the flowchart in FIG. 15.
Figure 16B:
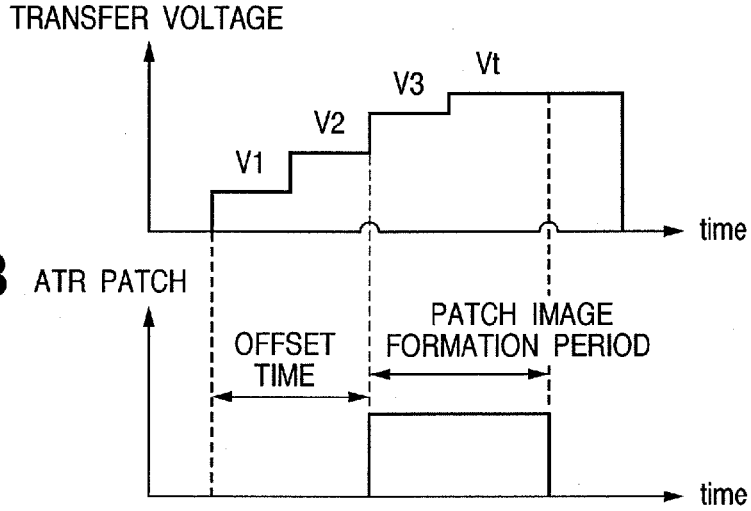
Figure 16C:
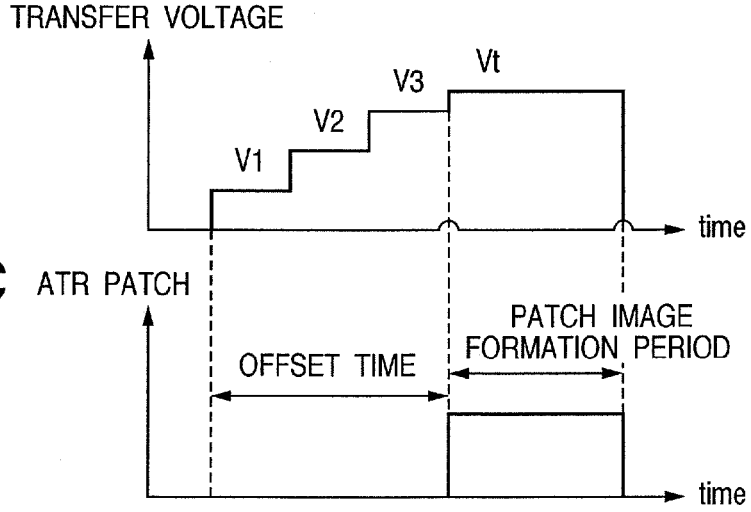

FIGS. 16A to 16C depict supplementary diagrams illustrating the process shown in the flowchart in FIG. 15. The voltage values V1 to V3 in FIGS. 16A to 16C correspond to those in the flowchart in FIG. 9.

FIG. 16A shows the offset time set in step S37. The ATVC transfer voltage V1 is a level at which the patch image is unlikely to be correctly transferred. Accordingly, the patch is not transferred at the transfer voltage V1. The timing is thus set such that the patch image is transferred simultaneously with the application of the transfer voltage V2. Further, the patch may continue to be transferred after the ATVC has been finished. A high voltage level Vt (target voltage value) for normal image formation is thus set for a predetermined duration after the setting and sampling of the transfer voltage V3.

Similarly, FIG. 16B shows the offset time in step S35. In this case, the timing is set such that the patch image is transferred simultaneously with the application of the transfer voltage V3.

FIG. 16C shows the offset time in step S34. In this case, the patch image is transferred to the intermediate transfer member 5*a* when the voltage reaches the high voltage level Vt for normal image formation immediately after the ATVC transfer voltage has been set at V3.

This makes it possible to minimize a decrease in productivity resulting from the adjustment of the image density with the degradation of the photosensitive drum taken into account.

ANOTHER EMBODIMENT

The sampling value may vary as a result of a variation in the ATVC high transfer voltage level during the transfer of the ATR patch. Thus, this embodiment sets the unit time for setting and sampling of the ATVC transfer voltage longer than the time corresponding to the length of the ATR patch. This avoids varying the transfer voltage set value during the formation of an ATR patch image. Such a setting enables an increase in the accuracy of the ATR patch. The configuration of the image forming apparatus in this embodiment is similar to that in the above embodiment and will not be described.

As described above, the present embodiment makes it possible to minimize a decrease in productivity resulting from the adjustment of the image density.

The above embodiments focus on the ATR control, which is performed simultaneously with the ATVC. However, patch control such as maximum density correction (DMAX) or auto color shift correction may be effectively used. In particular, the auto color shift correction focuses on the position where the patch is formed (patch edge) rather than on the density of the patch. This correction thus enables the use of a configuration similar to that in the above embodiment while offering a wider allowable range of density variations than the ATR patch.

As described above, the present embodiment performs the ATVC and ATR patch control in parallel taking the possible degradation of the photosensitive drum into account. The present embodiment thus determines whether or not to perform adjustive control, on the basis of measurements; the adjustive control is performed as required by a device to be controlled. This enables the fixed duration required for adjustments to be reduced to be equal to the minimum required time. This effectively increases the productivity of the apparatus, while enabling the required adjustive control to be performed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Laid-Open No. 2005-252468, filed on Aug. 31, 2005, which is hereby incorporated by reference herein in its entirety.

What is claimed is:

1. An image forming apparatus for forming an image by transferring an image formed on an image carrier and developed with a developing material, to an intermediate transfer member and then transferring the image to a transfer member, the apparatus comprising:

a density adjustment unit configured to detect and adjust the density of a patch image transferred to the intermediate transfer member;

a transfer voltage determining unit configured to gradually vary a transfer voltage to determine a transfer voltage for a transfer of the image from the image carrier to the intermediate transfer member;

a determination unit configured to determine how the image carrier is degraded; and a control unit configured to, in accordance with the determination by said determination unit, control a transfer timing for a transfer of the patch image to the intermediate transfer member, in parallel with the determination by said transfer voltage determining unit.

2. An image forming apparatus for forming an image by transferring an image formed on an image carrier and developed with a developing material, to an intermediate transfer member and then transferring the image to a transfer member, the apparatus comprising:

a density adjustment unit configured to detect and adjust the density of a patch image transferred to the intermediate transfer member;

a transfer voltage determining unit configured to gradually vary a transfer voltage to determine a transfer voltage for a transfer of the image from the image carrier to the intermediate transfer member;

a determination unit configured to determine how the image carrier is degraded; and a control unit configured to, in accordance with the determination by said determination unit, control a transfer timing for a transfer of the patch image to the intermediate transfer member, with respect to the transfer voltage gradually varied by said transfer voltage determining unit.

3. An image forming apparatus for forming an image by transferring an image formed on an image carrier and developed with a developing material, to an intermediate transfer member and then transferring the image to a transfer member, the apparatus comprising:

a density adjustment unit configured to transfer and form a patch image on the intermediate transfer member and to detect and adjust the density of the patch image;

a transfer voltage control unit configured to gradually raise a transfer voltage to measure a transfer current and to generate a transfer voltage corresponding to a target transfer current to control a transfer of the image from the image carrier to the intermediate transfer member; and a control unit configured to perform control such that a timing at which said density adjustment unit forms the patch image is determined in association with the transfer voltage generated by said transfer voltage control unit to allow a density adjustment process using said density adjustment unit and said transfer voltage control unit to be executed in parallel.

4. The image forming apparatus according to claim 3, wherein the density adjustment process using said transfer voltage control unit is automatic transfer voltage control (ATVC).

5. The image forming apparatus according to claim 3, further comprising:

an acquisition unit configured to acquire information on an environment in which the image forming apparatus is installed; and a unit configured to acquire use period information on a period for which the image carrier has been used, wherein said control unit determines the formation timing for the patch image on the environment information and the use period information.

6. The image forming apparatus according to claim 3, further comprising a table configured to store the target transfer current in accordance with a mode in which the image is formed as well as characteristics of the transfer member.

7. The image forming apparatus according to claim 3, wherein said density adjustment unit compares the detected density of the patch image with a target density of the patch image to control the amount of developing material supplied in accordance with the comparison.

8. A density adjustment method for an image forming apparatus for forming an image by transferring an image formed on an image carrier and developed with a developing material, to an intermediate transfer member and then transferring the image to a transfer member, the method comprising:

a density adjustment step of transferring and forming a patch image on the intermediate transfer member and detecting and adjusting the density of the patch image;

a transfer voltage control step of gradually raising a transfer voltage to measure a transfer current and generating a transfer voltage corresponding to a target transfer current to control a transfer of the image from the image carrier to the intermediate transfer member; and a control step of controlling such that a timing at which the patch image is formed in said density adjustment step is determined in association with the transfer voltage generated in said transfer voltage control step, and executing a density adjustment process using said density adjustment step and said transfer voltage control step in parallel.

9. The method according to claim 8, wherein the density adjustment process using said transfer voltage control step is automatic transfer voltage control (ATVC).

10. The method according to claim 8, further comprising:

an acquisition step of acquiring information on an environment in which the image forming apparatus is installed; and a step of acquiring use period information on a period for which the image carrier has been used, wherein said control step determines the formation timing for the patch image on the basis of the environment information and the use period information.

11. The method according to claim 8, further comprising a table configured to store the target transfer current in accordance with a mode in which the image is formed as well as characteristics of the transfer member.

12. The method according to claim 8 wherein said density adjustment step compares the detected density of the patch image with a target density of the patch image to control the amount of developing material supplied in accordance with the comparison.

* * * * *

UNITED STATES PATENT AND TRADEMARK OFFICE

CERTIFICATE OF CORRECTION

PATENT NO. : 7,403,727 B2
APPLICATION NO. : 11/465971
DATED : July 22, 2008
INVENTOR(S) : Takashi Fujimori et al.

It is certified that error appears in the above-identified patent and that said Letters Patent is hereby corrected as shown below:

On the Title page
In Section (56) References Cited Field: The Foreign Patent Document listed as "JP 2002-186848 A" should be -- JP 2002-156848 A --

Signed and Sealed this

Twenty-sixth Day of August, 2008

JON W. DUDAS
*Director of the United States Patent and Trademark Office*